US012366057B2

(12) United States Patent
Swarte et al.

(10) Patent No.: US 12,366,057 B2
(45) **Date of Patent: *Jul. 22, 2025**

(54) CEILING MOUNTED KITCHEN FAUCET

(71) Applicant: Kohler Co., Kohler, WI (US)

(72) Inventors: Gregory de Swarte, Sheboygan, WI (US); Jacob Frye, Sheboygan Falls, WI (US); David Wortelboer, Sheboygan, WI (US); Rodney Weekley, Mequon, WI (US); Drew Johnson, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/396,601

(22) Filed: Dec. 26, 2023

(65) Prior Publication Data

US 2024/0209600 A1 Jun. 27, 2024

Related U.S. Application Data

(63) Continuation of application No. 17/244,002, filed on Apr. 29, 2021, now Pat. No. 12,071,749.

(Continued)

(51) Int. Cl.
*E03C 1/04* (2006.01)

(52) U.S. Cl.
CPC ..... *E03C 1/04* (2013.01); *E03C 2001/0415* (2013.01); *E03C 2001/0417* (2013.01)

(58) Field of Classification Search
CPC ... E03C 1/04; E03C 1/06; E03C 1/066; E03C 1/021; E03C 2001/0415; E03C 2001/0417;

(Continued)

(56) References Cited

U.S. PATENT DOCUMENTS 4,809,369 A 3/1989 Bowden
5,871,029 A 2/1999 Peteri (Continued)

FOREIGN PATENT DOCUMENTS

CN 201891204 7/2011
CN 203627979 6/2014

(Continued)

OTHER PUBLICATIONS

China Office Action corresponding to CN202110499295.1, dated Sep. 30, 2022.

(Continued)

*Primary Examiner* — Lori L Baker

(74) *Attorney, Agent, or Firm* — Husch Blackwell LLP

(57) ABSTRACT

A faucet system includes a housing assembly configured to be coupled to a ceiling structure, wherein the housing includes a mixing valve disposed therein. The faucet system further includes a hose assembly coupled to the housing assembly. The hose assembly includes a flexible hose being fluidly coupled to the mixing valve and configured to hang below the housing assembly, a rotatable arm coupled to the housing assembly, and a control knob communicably coupled to the mixing valve. The rotatable arm is configured to facilitate rotation and adjustment of the hose and the control knob configured to control at least one of a temperature or a flow of water within the faucet system.

18 Claims, 23 Drawing Sheets

Related U.S. Application Data

(60) Provisional application No. 63/021,781, filed on May 8, 2020.

(58) Field of Classification Search
CPC .... E03C 1/042; E03C 2001/028; E03C 1/025; E03C 1/063; B65H 2701/33; B65H 75/366; B65H 75/48; B65H 2701/35; A47L 17/00
USPC ..... 4/615, 567, 596, 620, 670, 903
See application file for complete search history.

(56) References Cited

U.S. PATENT DOCUMENTS

| | | | | |
|---|---|---|---|---|
| D586,428 | S | 2/2009 | Carlson et al. | |
| D605,260 | S | 12/2009 | Allard | |
| D653,309 | S | 1/2012 | Starck | |
| 8,683,624 | B1 | 4/2014 | Zhadanov et al. | |
| D709,166 | S | 7/2014 | Yu | |
| 9,578,994 | B2 | 2/2017 | Capp et al. | |
| 10,369,578 | B2 | 8/2019 | Allard | |
| D903,050 | S | 11/2020 | Ando et al. | |
| D913,438 | S | 3/2021 | Levi | |
| D930,791 | S | 9/2021 | Williams et al. | |
| 2016/0237661 | A1 | 8/2016 | Teagarden | |
| 2019/0071851 | A1 | 3/2019 | Meehan | |
| 2019/0368175 | A1* | 12/2019 | Abood | B65H 75/486 |
| 2020/0032495 | A1 | 1/2020 | Ye | |
| 2020/0248438 | A1 | 8/2020 | Wang et al. | |
| 2021/0229114 | A1 | 7/2021 | Trefren | |
| 2021/0348367 | A1* | 11/2021 | Swarte | A47L 17/00 |

FOREIGN PATENT DOCUMENTS

| | | |
|---|---|---|
| CN | 204911852 | 12/2015 |
| CN | 206616755 | 11/2017 |
| CN | 207640863 | 7/2018 |
| CN | 208041266 | 11/2018 |
| CN | 208331379 | 1/2019 |
| CN | 208650177 | 3/2019 |
| CN | 111851660 | 10/2020 |
| DE | 1482696 | 4/1969 |

OTHER PUBLICATIONS

English Summary of China Office Action corresponding to CN202110499295.1, dated Sep. 30, 2022.

Extended European Search Report on EP Appl. Ser. No. 21171634.5 dated Nov. 22, 2021.

Amazon.com, AXOR ShowerSolutions Ceiling Connector, posted Jun. 14, 2018, [online], [visited Apr. 26, 2022]. Internet, <URL: https://www.amazon.com/Luxury-Ceiling-Mounted-Chrome Bathtub/dp/B08DZCBDX1 > (Year: 2018).

Amazon.com, Ideal Standard Idealrain Vertical Ceiling Arm, posted Apr. 19, 2013, [online], [visited Apr. 26, 2022]. Internet, <URL: https://www.amazon.co.uk/Ideal-Standard-Idealrain-B9446AA-Chrome-Plated/dp/B008DCTP7G/ref> (Year: 2013).

Amazon.com, Luxury ceiling mounted basin sink spout, posted Jul. 30, 2020, [online], [visited Apr. 26, 2022]. Internet, <URL: https://www.amazon.com/Luxury-Ceiling-Mounted-Chrome-Bathrub/dp/B08DZCBDX1 > (Year: 2020).

Youtube.com, Kohler's $6235 kitchen faucet hangs from your ceiling, posted Jan. 6, 2022, [online], [visited Apr. 26, 2022]. Internet, <URL: htpps://www.youtube.com/watch?v=FsaXDVWLwg8> (Year: 2022).

Gizmodo, Ceiling-Mounted Bathroom Faucet Would be Great for Quick Showers. 2009. https://gizmodo.com/ceiling-mounted-bathroom-faucet-would-be-great-for-quic-5390931.

* cited by examiner

CEILING MOUNTED KITCHEN FAUCET

CROSS-REFERENCE TO RELATED APPLICATIONS

This is a continuation of U.S. application Ser. No. 17/244,002, filed Apr. 29, 2021, which claims the benefit of U.S. Provisional Application No. 63/021,781, filed May 8, 2020, the disclosures of which are incorporated herein by reference in their entireties.

BACKGROUND

The present application relates generally to the field of ceiling mounted faucets intended for use in home, restaurant, and commercial environments, and includes a manner for mounting to ceiling joists.

Existing kitchen faucets, which are generally fixed within an area (e.g., counter) surrounding a sink may have limited range and are unable to supply water to all needed areas. In addition, the size of the faucet assembly may impose limitations on what items can be put into a sink. For example, some cookware (e.g., pots) may be too tall to fit beneath standard kitchen sink faucets, inhibiting the ability to fill or wash them. Some faucet models may have extendable components allowing a hose or water outlet to have additional reach, which enables water supply to areas outside the sink area and to items that may not fit within the sink. However, such counter-mounted designs, though having extendable features, still impose limitations on use as the extendable portions require perpetual support (e.g., holding) by a user. In addition, hose components corresponding to extendable portions of counter-mounted faucet designs are typically stored beneath the sink when not in an extended configuration, which may lead to tangling or snagging of the hose components.

Accordingly, it would be advantageous to provide an improved faucet assembly that has an unobtrusive mounting scheme and includes moveable and adjustable components that may be precisely positioned to enable water supply to an extended range of locations otherwise inaccessible via existing faucet designs.

SUMMARY

One aspect of the disclosure relates to a faucet system including a housing configured to be coupled to a ceiling structure. The housing is further coupled to a baseplate, wherein the housing includes a mixing valve disposed therein. The faucet system further includes a flexible hose fluidly coupled to the housing and configured to hang below the housing and receive water mixed by the mixing valve, a spray head disposed at a terminal end of the hose, and a rotatable arm coupled to the baseplate wherein the rotatable arm is configured to facilitate rotation and adjustment of the hose and the spray head.

In various embodiments, the faucet system further includes a cord extending from the housing, wherein the cord is supported by the rotatable arm. In some embodiments, a terminal end of the cord is connected to a coupling, the coupling being configured to hold the hose to facilitate positioning and movement of the hose. In other embodiments, the housing is disposed within the ceiling structure. In yet other embodiments, the housing is disposed below the ceiling structure. In various embodiments, the faucet system further includes a controller, the controller configured to control the mixing valve within the housing. In some embodiments, the controller is further configured to operate according to a plurality of modes, wherein each of the plurality of modes determines at least one of a temperature or a flow of water through the spray head. In other embodiments, the plurality of modes comprises a default mode, a gentle mode, and a boost mode.

According to another aspect of the disclosure, a faucet system includes a housing having a mixing valve disposed therein. The faucet system further includes a hose assembly coupled to the housing assembly, wherein the housing assembly includes a flexible hose configured to hang below the housing assembly and fluidly coupled to the mixing valve. The hose assembly further includes a cord extending from the housing assembly, a coupling connected to a terminal end of the cord, and a rotatable arm coupled to the housing assembly. The coupling is configured to hold the hose to facilitate positioning and movement of the hose and the rotatable arm is configured to facilitate rotation and adjustment of the hose and the spray head.

In various embodiments, the cord is configured to pass through the rotatable arm such that the terminal end of the cord extends from a distal end of the rotatable arm. In some embodiments, the cord is supported by a wheel disposed within the housing assembly. In other embodiments, the wheel is configured to maintain and adjust a length of the cord. In some embodiments, maintaining and adjusting the length of the cord include extending and retracting the cord. In various embodiments, the terminal end of the cord forms a loop, the loop being configured to connect to a tab disposed within the coupling.

According to yet another aspect of the disclosure, a faucet system includes a housing assembly configured to be coupled to a ceiling structure, a hose assembly coupled to the housing assembly, and a control knob communicably coupled to the mixing valve, the control knob configured to control at least one of a temperature or a flow of water within the faucet system. The housing includes a mixing valve disposed therein. The hose assembly includes a flexible hose, which is fluidly coupled to the mixing valve and configured to hang below the housing assembly, and a rotatable arm coupled to the housing assembly, wherein the rotatable arm is configured to facilitate rotation and adjustment of the hose.

In various embodiments, the control knob includes a top portion and a bottom portion, wherein the top portion is configured to rotate relative to the bottom portion, and wherein rotation of the top portion controls at least one of the temperature or the flow of the water within the faucet system. In some embodiments, the top portion of the control knob includes one or more buttons disposed within a top surface, the one or more buttons configured to operate the faucet system based on one or more modes. In various embodiments, the one or more modes includes at least one of a default mode, a gentle mode, and a boost mode. In some embodiments, the housing assembly further includes a cord extending from the housing assembly, wherein the cord is supported by the rotatable arm and a terminal end of the cord is connected to a coupling, and wherein the coupling is configured to configured to hold the hose to facilitate positioning and movement of the hose. In various embodiments, the housing assembly further includes a wheel configured to maintain and adjust a length of the cord, and wherein the wheel is at least one of a counterbalance wheel.

BRIEF DESCRIPTION OF THE DRAWINGS

A clear conception of the advantages and features constituting the present disclosure, and of the construction and operation of typical mechanisms provided with the present disclosure, will become more readily apparent by referring to the exemplary, and therefore nonlimiting, embodiments illustrated in the drawings accompanying and forming a part of this specification, wherein like reference numerals designate the same elements in the several views, and in which.

Figure 1:
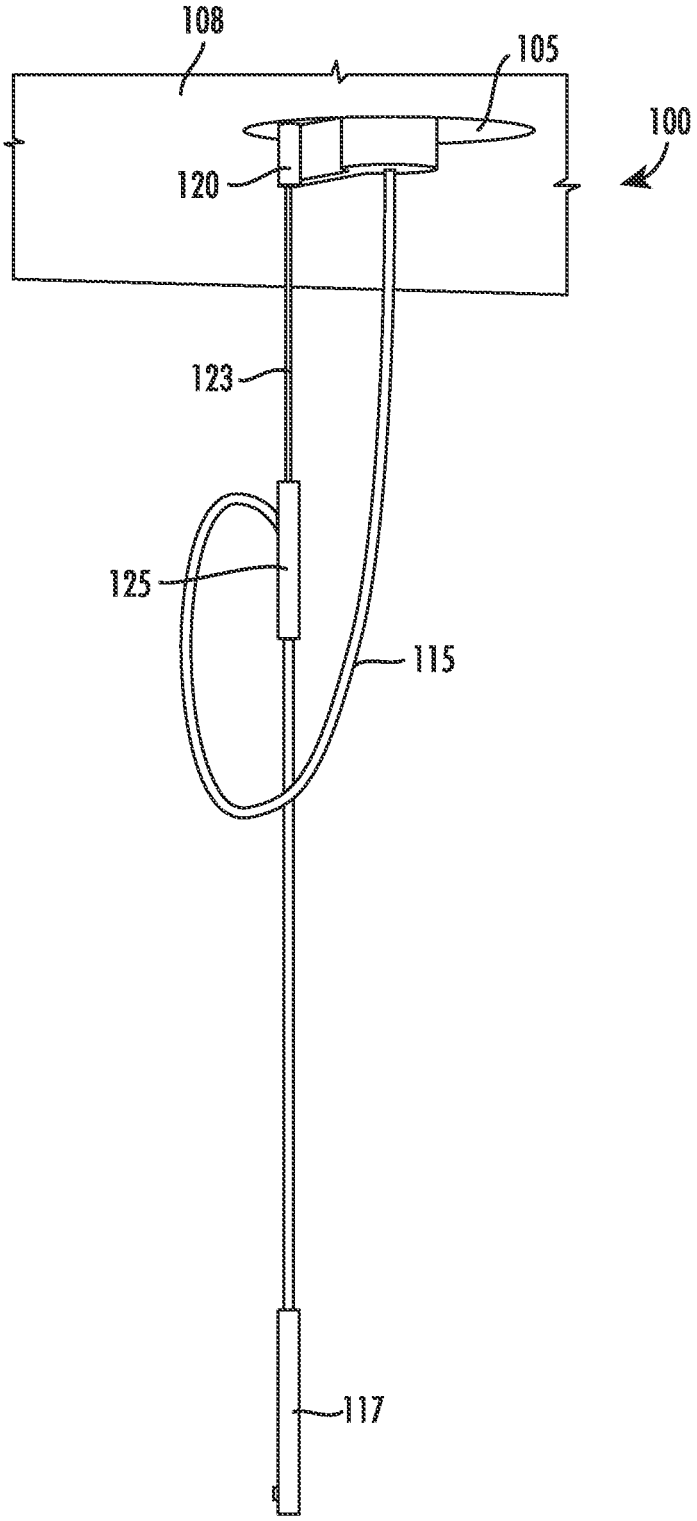
FIG. 1 is a side view of a faucet system, according to an exemplary embodiment.

The foregoing and other features of the present disclosure will become apparent from the following description and appended claims, taken in conjunction with the accompanying drawings. Understanding that these drawings depict only several embodiments in accordance with the disclosure and are therefore, not to be considered limiting of its scope, the disclosure will be described with additional specificity and detail through use of the accompanying drawings.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

One embodiment of the resent disclosure relates to a faucet system that includes a base plate, a flexible hose, and a spray head. The base plate is configured to be coupled to a ceiling. The hose is fluidly coupled to the spray head and configured to provide a flow of water to the spray head. The hose also extends through the base plate and through the ceiling.

In various embodiments, the faucet system includes a mixing valve (e.g., disposed behind the ceiling). The mixing valve (e.g., valve, mixing valve, etc.) is configured to receive and combine water from hot and cold conduits to create the flow of water received by the hose. In various embodiments, the mixing valve may be mechanical or electrical. In embodiments, where the mixing valve is mechanical, the mixing valve may further include or be coupled to or in communication with more electronic receivers.

In various embodiments, the faucet system also includes a coupling (e.g., sleeve, hook, etc.) and a cord (e.g., wire, cable, etc.). The coupling is coupled along the hose upstream from the spray head. The cord extends between the coupling and the base plate. In some embodiments, the cord is coupled to the base plate. In other embodiments, the cord extends through the base plate and through the ceiling.

In various embodiments, the faucet system also includes a wheel (e.g., reel, pulley) disposed behind the ceiling. The wheel is configured to support movement of the cord as it extends through the base plate and through the surface. In various embodiments, the wheel may include or may be coupled to one or more counterbalance weights to enable the cord to extend at a fixed length through the base plate. In some embodiments, the wheel may include removable weights that allow for adjustment of the weight of the wheel.

In some embodiments, the cord retracts via a spring (e.g., constant force spring) operatively coupled to the wheel. In various other embodiments, the wheel may be a retraction wheel to facilitate changing an extended length of the cord.

In various embodiments, the faucet system may include an arm coupled to the base plate and configured to rotate about the hose. The cord may extend through the arm, such as out of an end of the arm. The arm may extend beyond the perimeter of the base plate, allowing additional reach and flexibility to the position of the spray head.

In various embodiments, the faucet system may be configured for installation below a ceiling surface for a less-invasive configuration. The faucet system may consequently receive water and/or power supply from conduits situated below a ceiling surface. In other embodiments, the faucet system may include a central extended portion, enabling the arm to move and rotate at a greater distance from the base plate. The extended portion enables the faucet system 100 to be installed in or near a variety of ceiling structure configurations (e.g., vaulted ceilings).

In various embodiments, the faucet system may include a coupling coupled to the cord and the hose. The coupling may be configured to hold (e.g., grasp, clamp, hook, etc.) the hose such that it includes a controllable amount of slack, which ultimately facilitates a setting a vertical position of the spray head. Maintaining and controlling the amount of slack in the hose enables the faucet system to control the position of the spray head without requiring a mechanism for increasing or decreasing a length of the hose (e.g., via a reel).

Various embodiments of the faucet system may also include a control fixture (e.g., interface, remote, knob, switch, toggle joystick, etc.) mounted near the sink. In other embodiments, the control fixture may be disposed within the spray head. In various implementations, the control fixture may be in wireless communication with the mixing valve, controlling a flow, a temperature, and a flow rate of the water through the spray head. In various embodiments, the control fixture may be coupled to a wired (e.g., connection to an AC outlet) or a wireless (e.g., battery) power source. In various embodiments, the control fixture may implement one or more preset modes for operation, which enable a user to adjust parameters associated with a flow of water through the faucet system. In various embodiments, the control fixture may include a control dial to facilitate temperature adjustment of the flow of water through the faucet system.

In various embodiments, the spray head may include task lighting to facilitate improved visibility while using the faucet system. In other embodiments, task lighting may be included near the base plate of the faucet system. In various other embodiments, the faucet system may include fixtures for display lighting to provide additional light to an area containing the faucet system.

In various embodiments, the faucet system may be in communication with a user application, such that the application may track water usage associated with the faucet system and provide feedback and/or summary information related to water usage.

Referring generally to the figures, a faucet system includes a base plate coupled to a ceiling structure (e.g., joist), a mixing valve disposed above the base plate, a flexible hose coupled to the mixing valve and passing through the base plate, and a spray head coupled to an end of the hose. The mixing valve, which is located above the base plate and within a ceiling region (e.g., between joists), is configured to receive and mix water supply from hot and cold water conduits. The hose is coupled to the mixing valve and is configured to receive water mixed within the mixing valve. The hose is further configured to pass through a hole within the base plate and extend into a space below a ceiling surface (e.g., drywall, plaster). The spray head is coupled to a terminal end of the hose extending below the ceiling surface and is configured to facilitate and control water flow out of the hose. In various embodiments, the spray head may include one or more controls (e.g., buttons, valves, switches, knobs) to control water flow out of the hose.

In various exemplary embodiments, the faucet system may further include a rotatable arm, configured to engage with and rotate about a connection within the base plate. The rotatable arm may be configured to receive a cord. The cord may be supported by a wheel disposed above the base plate within the ceiling space. A terminal end of the cord, opposite an end coupled to the wheel, may pass through a hole within the base plate and through a channel within the rotatable arm, and extend out from a distal portion of the rotatable arm. The rotatable arm may include one or more additional wheels or pulleys therein to facilitate movement of the cord therethrough. The terminal end of the cord may include a connector (e.g., hook) configured to couple with a coupling, wherein the coupling is further configured to engage with and facilitate positioning and rotation of the hose. The coupling enables controlling an amount of slack in the hose, which enables adjusting a position of the spray head without requiring a mechanism for changing a length of the hose (e.g., via a reel). In some embodiments, the cord may further be configured to retract and extend, as facilitated by the wheel and/or a mechanism operatively coupled to the wheel (e.g., a spring).

In various exemplary embodiments, the faucet system may include a control fixture, configured to control operations of the mixing valve, and consequently, control the water within the hose and spray head. In various implementations, the control fixture may control a flow, a temperature, and a flow rate of water exiting the faucet system via the spray head. In various embodiments, the control fixture may be a knob, an interface, a remote, a switch, a toggle, joystick, or any other suitable mechanism known in the art. In various other embodiments, the control fixture may be disposed within the spray head.

In various embodiments, the faucet system may include one or more lighting fixtures. In some embodiments, the faucet system may include task lighting implements within the spray head, near the base plate, on or near the rotatable arm, or include a combination thereof. In other embodiments, the faucet system may include display lights near various components (e.g., base plate) to facilitate additional lighting of work areas and/or to enhance visual aesthetics or ambiance.

In various implementations, the faucet system may be in communication with a user application, configured to monitor, record, and summarize water use. In other implementations, the faucet system may be in communication with communicative media, such as a screen, for displaying instructive and/or entertaining content.

Referring now specifically to FIG. 1, a side view of a faucet system 100, according to an exemplary embodiment. As shown in FIG. 1, faucet system 100 is configured to mount to a ceiling surface 108 and includes a base plate 105, which is affixed to the ceiling surface 108. A flexible hose 115 is configured to pass through the base plate 105 and into a space below the ceiling surface 108. A terminal end of the hose 115 is coupled to a spray head 117, configured to control water flow out of the faucet system 100. System 100 also includes a rotatable arm 120 coupled to the base plate 105 and a housing assembly 103, which includes a cord 123 disposed therein. The cord 123 extends originates above the ceiling surface 108 and passes through the base plate 105 into the rotatable arm 120. A terminal end of the cord 123, which extends from a distal end of the rotatable arm, is coupled to a coupling 125. The coupling 125 is configured to hold the hose 115 and facilitate its positioning and movement. The coupling 125 is configured to facilitate controlling an amount of slack in the hose 115, which enables a setting a vertical position of the spray head 117 without requiring a mechanism for increasing or decreasing a length of the hose 115 (e.g., via a reel). Positioning and movement of the hose 115 is bounded by a length of the hose 115 and a radius of rotation of the rotatable arm 120 about a connection point between the rotatable arm 120 and the base plate 105. Movement of coupling 125 may cause rotation of rotatable arm 120 and movement of cord 123, which is supported by wheel 130 (e.g., reel, pulley), to enable positioning of hose 115 and coupled spray head 117. In various embodiments, the cord 123 is anchored by the wheel 130. In other embodiments, the cord 123 is anchored to a separate support disposed within the housing assembly 103.

Figure 2:
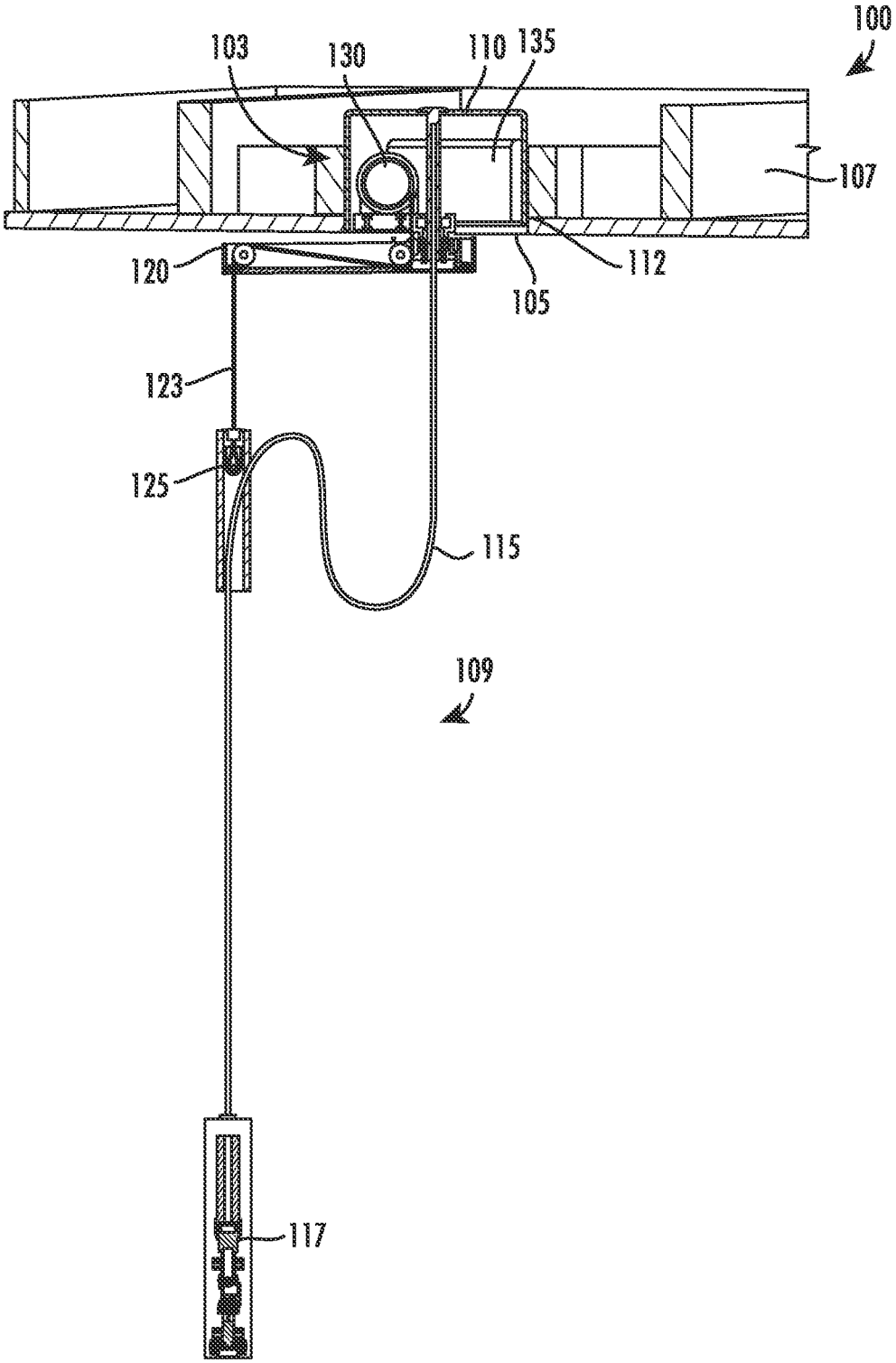
FIG. 2 is a perspective cross-sectional view of a faucet system, according to an exemplary embodiment.

FIG. 2 shows a perspective cross-sectional view of faucet system 100, according to an exemplary embodiment. Faucet system 100 includes a base plate 105 coupled to a ceiling structure 107 (e.g., joist). Disposed in a space within the ceiling structure 107, is the housing assembly 103, which includes a housing formed by top portion 110 and bottom portion 112. Housing assembly 103 contains a mixing valve 135 and wheel 130. Faucet system 100 also includes assembly 109, which includes components of system 100 that extend below a ceiling surface and/or the ceiling structure 107. As shown, hose 115 extends from the housing assembly 103, through base plate 105, and below the ceiling structure 107. Wheel 130, which is disposed within housing assembly 103, supports a cord 123. Cord 123 passes through base plate 105 and rotatable arm 120, and is coupled to coupling 125, which holds hose 115. Rotatable arm 120 is configured to be oriented substantially parallel to a plane defined by the base plate 105 and is further configured to rotate relative to base plate 105, enabling varied configurations of hose assembly 109.

Figure 3:
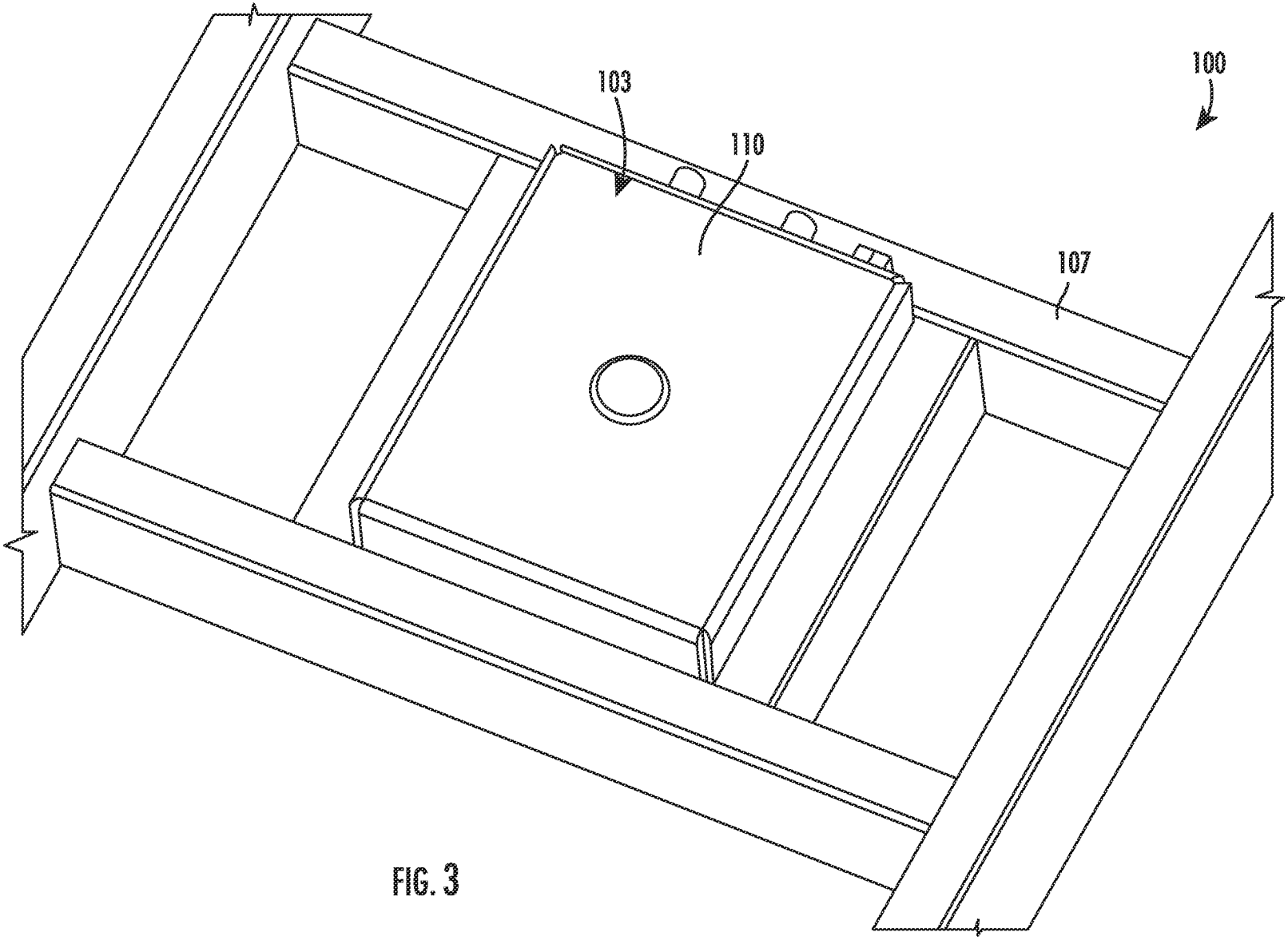
FIG. 3 is a top perspective view of the faucet system, according to an exemplary embodiment.

FIG. 3 shows a top perspective view of faucet system 100, according to an exemplary embodiment. FIG. 3 illustrates placement of faucet system 100, and specifically housing assembly 103, within a ceiling structure 107 space. As shown, housing assembly 103 is disposed within a space in the ceiling structure 107, and above a ceiling surface 108. Hose assembly 109 (comprising coupling 125 and hose 115), which is coupled to housing assembly 103, is disposed within a space below the ceiling structure 107 and ceiling surface 108. In various embodiments, housing assembly 103 may be disposed within a space below the ceiling structure 107 and affixed or otherwise coupled to ceiling surface 108. In various embodiments, housing assembly 103 may be configured as or contained within a substantially rectangular structure. In other embodiments, housing assembly 103 may be configured as or contained within a substantially cylindrical structure.

Figure 4:
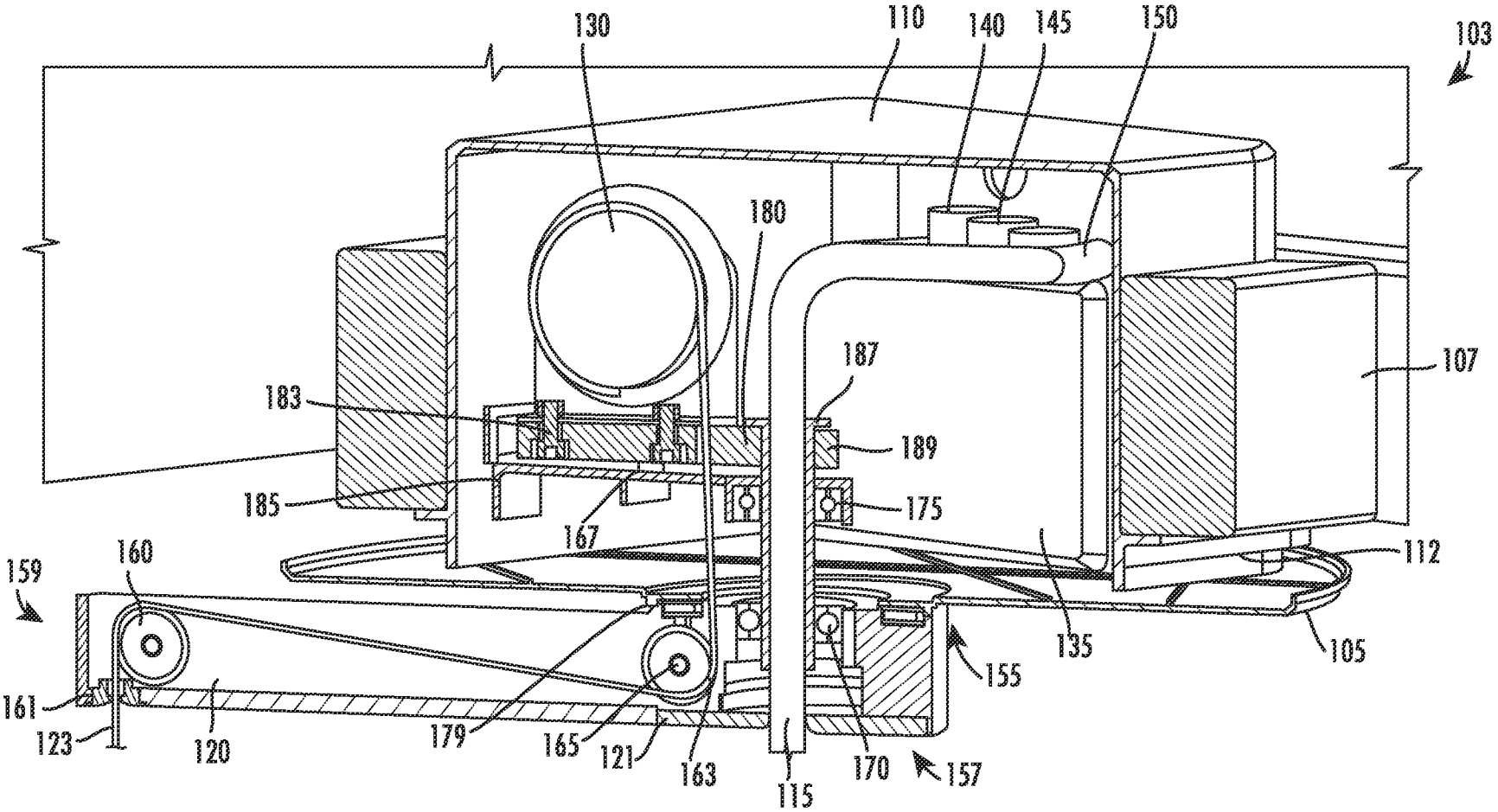
FIG. 4 is a perspective cross-sectional view of a faucet system near a housing assembly implementing a bracket design, according to an exemplary embodiment.

FIG. 4 shows a perspective cross-sectional view of a faucet system 100, configured to have a bracket support design, near housing assembly 103 according to an exemplary embodiment. As described previously, housing assembly 103 includes a main housing formed by a top portion 110 and a bottom portion 112. Housing assembly 103 is configured to fit within a space within a ceiling structure 107, such as joists. In various embodiments, housing assembly 103 may be coupled to a ceiling structure 107 via fasters fastened to top portion 110 and/or bottom portion 112. Housing assembly 103 contains a wheel 130, which is mounted on an arm 180 via fasteners 183. Arm 180 is configured to be coupled to a center post 187 at a joint 189 (e.g., via a sleeve, coupler, etc.). Wheel 130 is configured to support cord 123. Arm 180 includes an opening 167, which is configured to facilitate movement of cord 123 therethrough. In various embodiments, wheel 130 may be and/or coupled to the counterbalance wheel or pulley, configured to support cord 123 and maintain or adjust a constant length of extension of cord 123 through base plate 105. In various embodiments wherein wheel 130 is a counterbalance wheel or pulley, a counterbalance weight may be adjustable. In various other embodiments, wheel 130 may be a retraction wheel and/or coupled to a retraction mechanism (e.g., spring) to retract and extend cord 123 through base plate 105. In various embodiments, retraction and/or extension of cord 123 may be limited by arm 120, one or more couplings coupled to cord 123, a feature within arm 120, and/or a feature within housing 103.

Housing assembly 103 also includes mixing valve 135, which receives a water supply via hot and cold water conduits 140, and 145, respectively. In various embodiments, the mixing valve 135 may be an electronic valve. In other embodiments, the mixing valve 135 may be a mechanical valve. In some embodiments, the mixing valve 135 may include or be coupled to one or more electronic receivers. Mixed water within the mixing valve 135 may flow into hose 115 at port 150. The hose 115 is supported by a center post 187, which extends from the housing assembly 103 through the base plate 105 and into rotatable arm 120. Within housing assembly 103, post 187 engages with arm 180 and a bracket 185. Bracket 185 is coupled to the upper portion 110 of the housing assembly and engages with the post 187 via a first bearing coupler 175. Bracket 185 is configured to stabilize housing assembly 103 and components disposed therein. In various embodiments, housing assembly 103 may include a plurality of brackets similar or identical to bracket 185, each configured to stabilize housing assembly 103 and components disposed therein. Beneath housing assembly 103, post 187 engages with a second bearing coupler 170 disposed within the rotatable arm 120.

As shown in FIG. 4, rotatable arm 120 is coupled to base plate 105 at a joint 155. Rotatable arm 120 has a proximal end 157 and a distal end 159, wherein the proximal end 157 is coupled to base plate 105 and configured to rotate relative to the base plate 105 at joint 155. Spacers 179 are disposed within a space formed between proximal end 157 of rotatable arm 120 13 and base plate 105. A cap 121 is coupled to a bottom surface of rotatable arm 120 at proximal end 157 opposite joint 155. Rotatable arm 120 includes two pulleys 160 and 165 at distal end 159 and proximal end 157, respectively. As shown, cord 123 is configured to be supported by wheel 130 as it extends through opening 167 in arm 180, and into rotatable arm 120 at proximal end 157 via an opening 163. Cord 123 engages with pulleys 165 and 160, and passes through opening 161 at distal end 159 to extend into a space below ceiling structure 107 and base plate 105.

Figure 5:
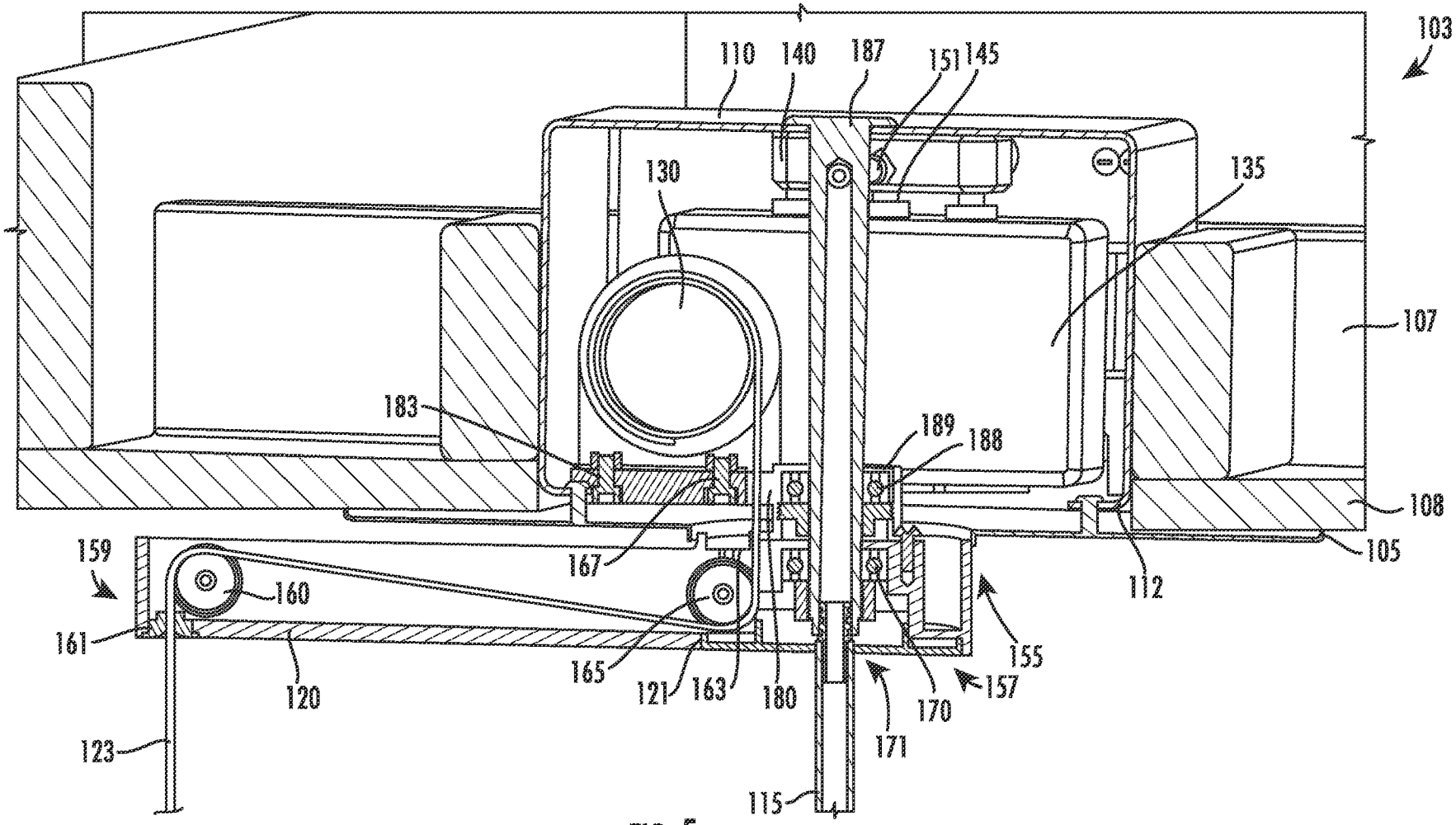
FIG. 5 is a perspective cross-sectional view of a faucet system near a housing assembly implementing a center post design, according to an exemplary embodiment.

FIG. 5 shows a perspective cross-sectional view of a faucet system 100, configured to have a center post mount design, near a housing assembly 103 according to an exemplary embodiment. In various embodiments, center post 187 within housing assembly 103 may be configured to extend an entire length of the housing assembly 103. As shown in FIG. 5, housing assembly 103 includes a wheel 130, which is mounted to an arm 180, and is configured to support cord 123. Arm 180 is coupled to center post 187, which extends from an upper surface of the top portion 110 of housing assembly 103, through base plate 105, and into rotatable arm 120. In various embodiments, center post 187 is coupled to the top portion 110 of housing assembly 103 (e.g., via press-fit, one or more fasteners, etc.). Center post 187 is configured to provide structural support to housing assembly 103 and components contained therein.

As shown, housing assembly 103 also contains a mixing valve 135, which is supplied water via hot and cold water conduits 140 and 145, respectively. In various embodiments, center post 187 may be configured to receive water from mixing valve 135 and facilitate water flow into hose 115. As shown, water mixed within mixing valve exits through port 151 into center post 187. As shown, hose 115 may be configured to be supported by post 187 (e.g., fit within) as it extends through the housing assembly 103 and into a space below the ceiling structure 107. As illustrated in FIG. 5, hose 115 engages with center post 187 at joint 171. In various embodiments, hose 115 may engage with center post 187 via a connector (e.g., coupling, threaded connector, etc.). In various other embodiments, hose 115 may engage with center post 187 via a press-fit and/or threaded connection.

Figure 6:
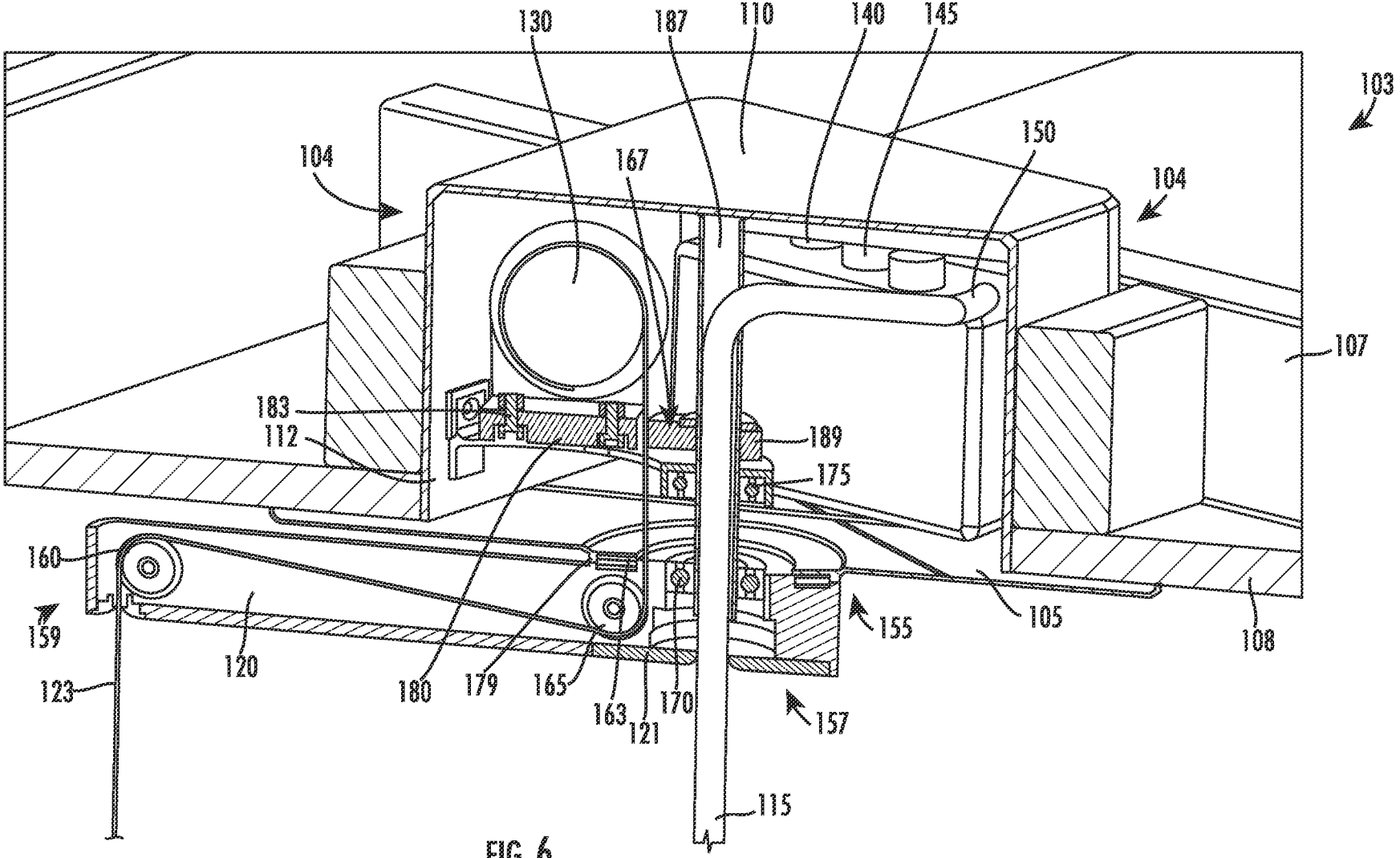
FIG. 6 is a perspective cross-sectional view of a faucet system near a housing assembly implementing a bracket and center post design, according to an exemplary embodiment.

FIG. 6 shows a perspective cross-sectional view of a faucet system 100, configured to have a bracket and center post design, near a housing assembly 103, according to an exemplary embodiment. As shown in FIG. 6, a housing assembly 103 may be configured to include both a center post 187 and one or more brackets 185 to provide structural support for the housing assembly 103 and components disposed therein. FIG. 6 shows center post 187 extending from an upper surface of top portion 110 of housing assembly 103, through base plate 105, and into rotatable arm 120. A bracket 185 is also coupled to a side wall of top portion 110 of housing assembly 103 and engages with center portion 187 via bearing coupler 175. In various embodiments, housing assembly 103 may include a plurality of brackets 185, each configured to provide structural support to housing assembly 103.

Figure 7:
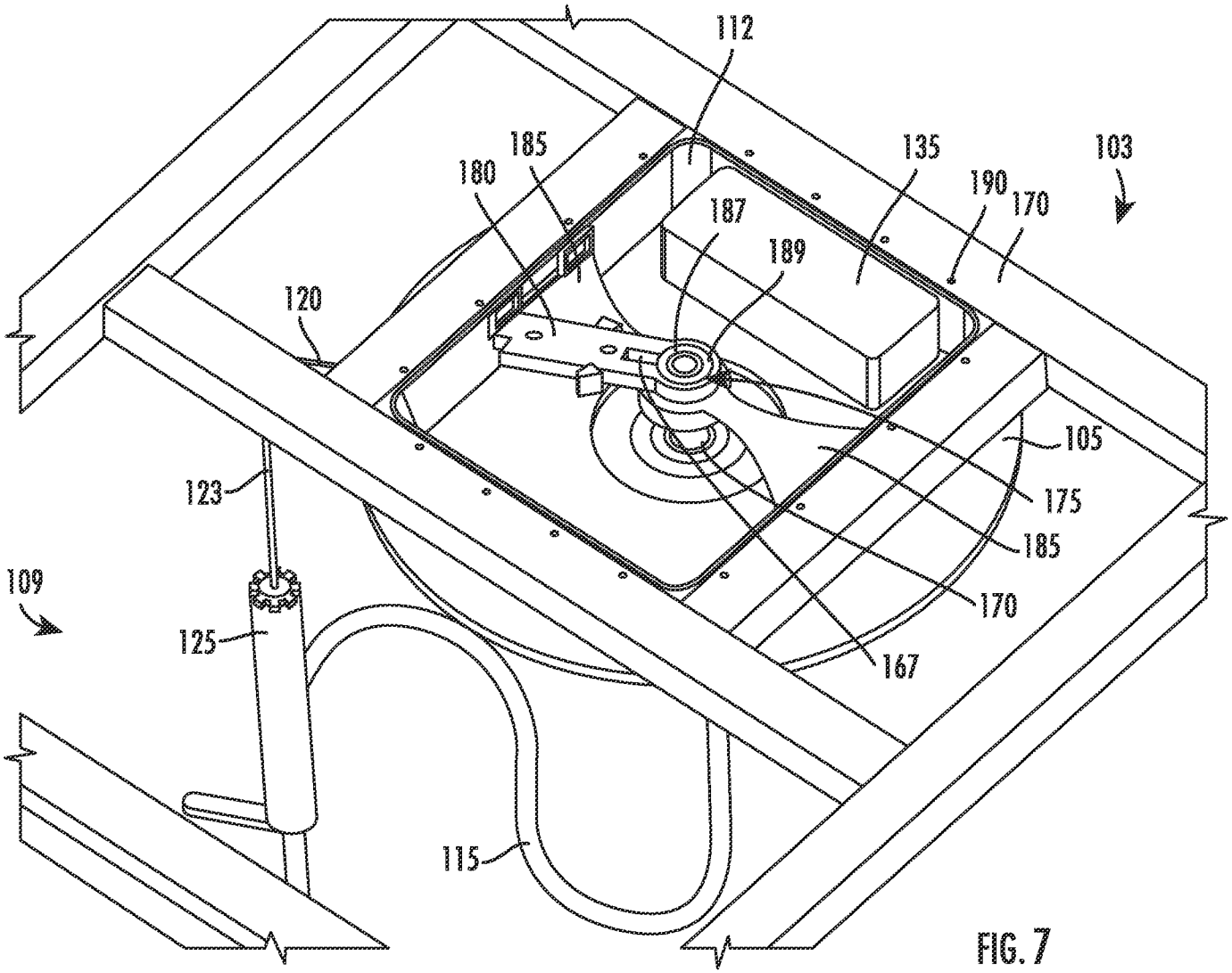
FIG. 7 is a top cross-sectional view of a faucet system implementing a bracket and center post design, according to an exemplary embodiment.

FIG. 7 shows a top cross-sectional view of a faucet system 100, according to an exemplary embodiment. As shown in FIG. 7, housing assembly 103 is disposed in a space within ceiling structure 107 and above a ceiling surface 108. Base plate 105 may positioned beneath ceiling surface 108, wherein base plate 105 is coupled to ceiling structure 107 via fasteners that pass through ceiling surface 108.

Housing assembly 103 may include more than one brackets 185 to provide support. FIG. 7 shows two brackets 185, but various embodiments of system 100 may include any number of brackets 185. FIG. 7 also illustrates relative configurations of arm 180 (to which wheel 130 is coupled), center post 187, brackets 185, and mixing valve 135.

As previously described, housing assembly 103 may be coupled to ceiling structure 107. As shown in FIG. 7, fasteners 190 may be implemented to mutually couple ceiling structure 107 and housing assembly 103 (e.g., via bottom portion 112). Fasteners 190 may include screws, bolts, washers, and/or any other sufficient fastener type or fastener component known in the art.

Figure 8:
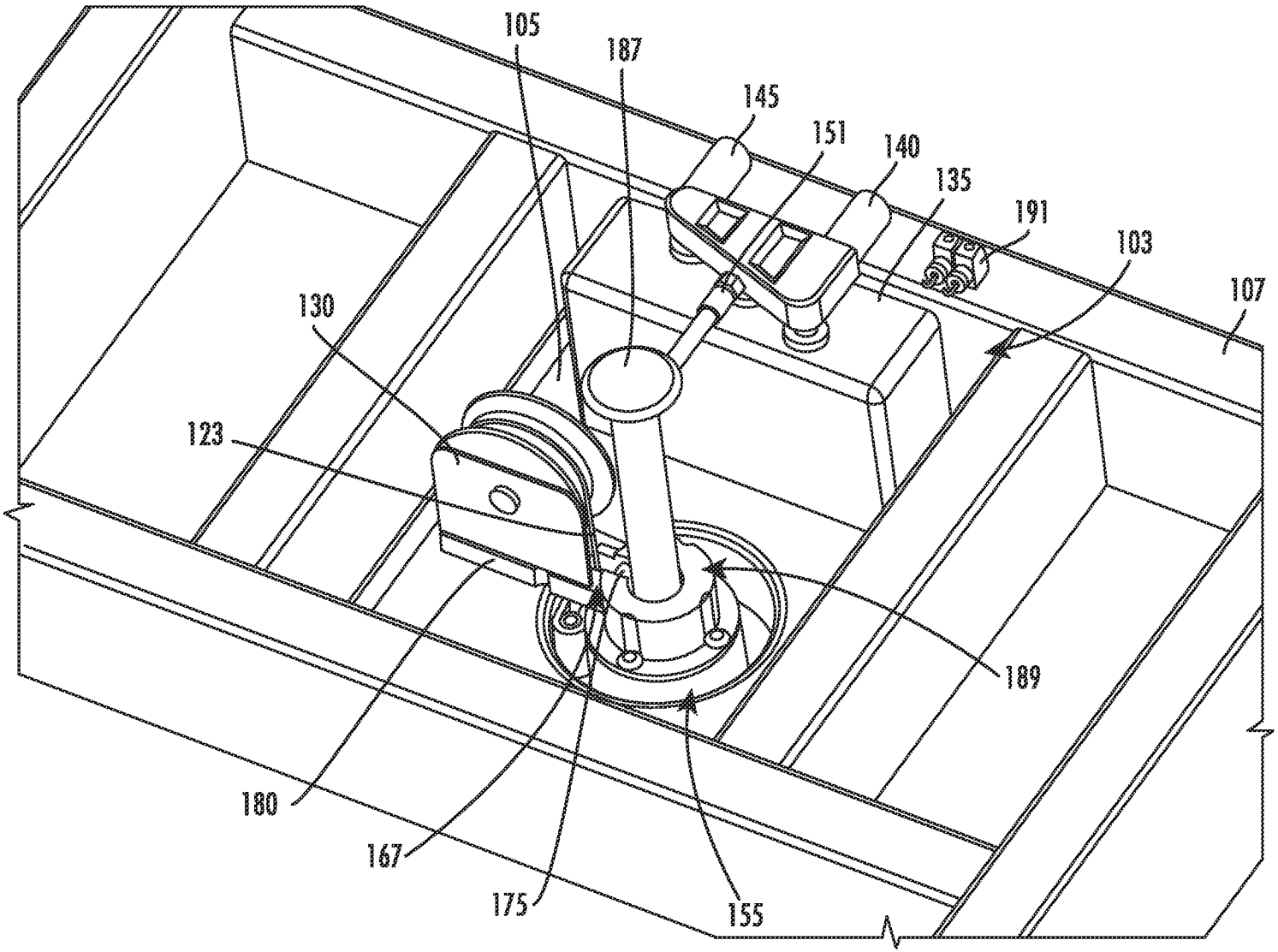
FIG. 8 is a top cross-sectional view of a faucet system implementing a center post design, according to an exemplary embodiment.

FIG. 8 shows a top cross-sectional view of a faucet system 100 implementing a center post design, according to an exemplary embodiment. As shown in FIG. 8, housing assembly 103 is disposed in a space within ceiling structure 107 and above a ceiling surface 108. Base plate 105 may positioned beneath ceiling surface 108, wherein base plate 105 is coupled to ceiling structure 107 (e.g., via one or more fasteners). FIG. 8 also illustrates relative configurations of arm 180 (to which wheel 130 is coupled), center post 187, and mixing valve 135. In various embodiments, power may be supplied to faucet system 100 via a supply port 191. Port 191 may be electrically coupled to a power source via wiring within ceiling structure 107 and/or wiring below ceiling structure 107.

Figure 9:
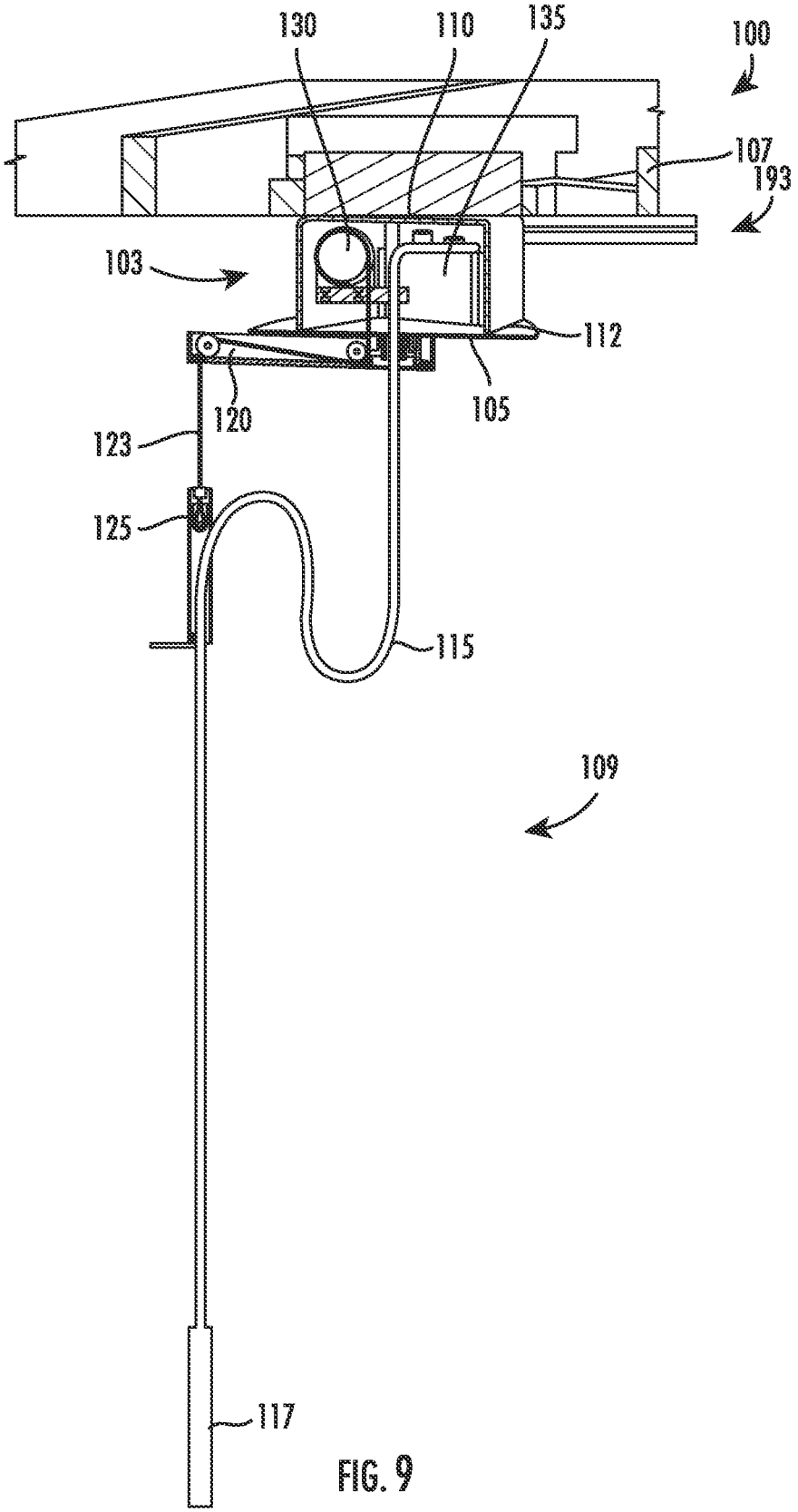
FIG. 9 is a side cross-sectional view of a faucet system disposed below a ceiling structure, according to an exemplary embodiment.
Figure 10:
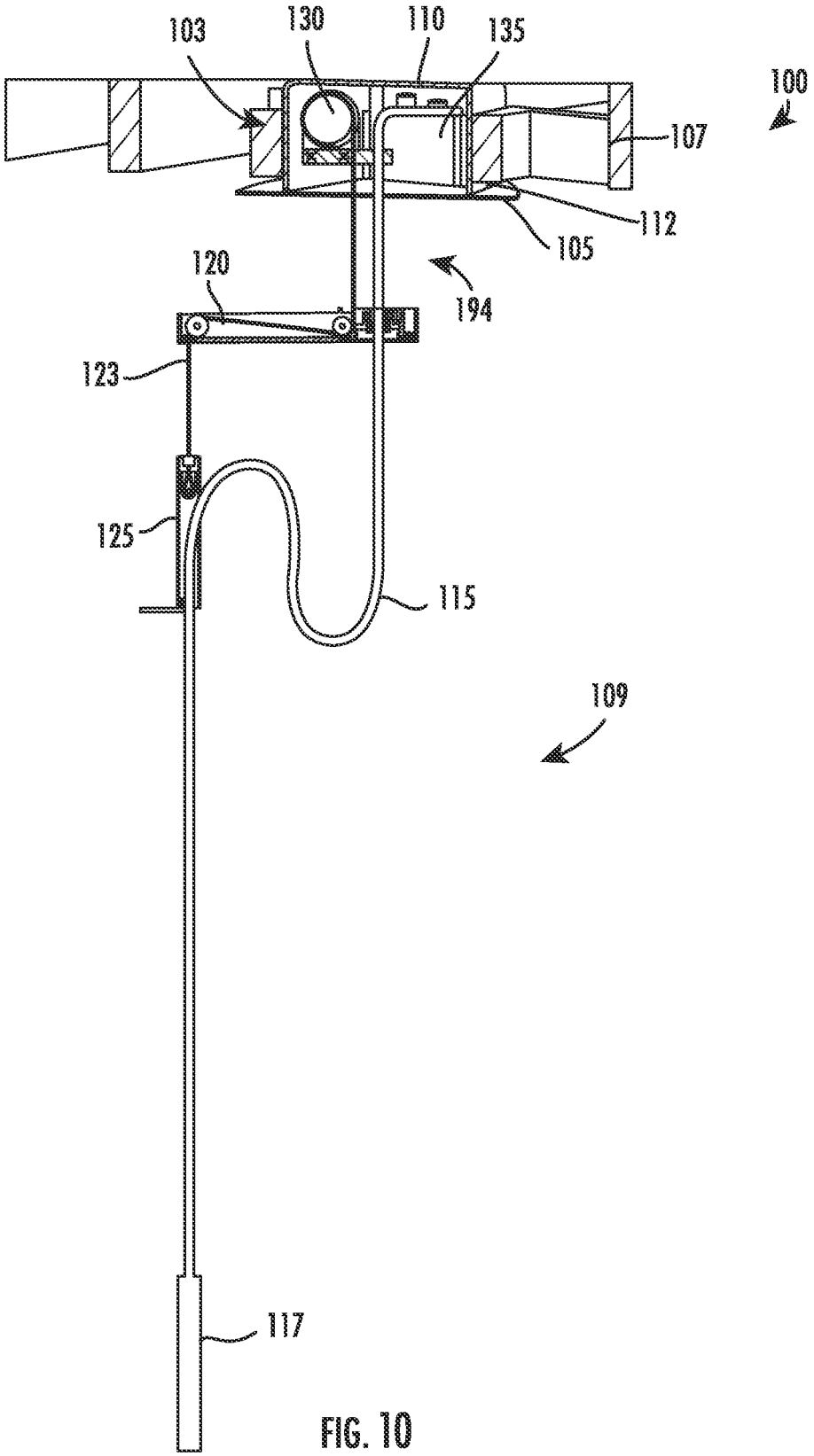
FIG. 10 is a side cross-sectional view of a faucet system including an extended portion, according to an exemplary embodiment.

FIGS. 9 and 10 show side cross-sectional views of a faucet system 100, according exemplary embodiments. As shown in FIG. 9, faucet system 100 may be configured such that housing assembly 103 is disposed below a ceiling structure 107 and receives a water and/or power supply via ports 193, which may be configured to run along a bottom surface of ceiling structure 107 (e.g., beneath or along ceiling surface 108). As shown in FIG. 10, in other embodiments, faucet system 100 may be disposed within a space adjacent to ceiling structure 107 and include an extended portion 194, which is configured to extend between housing assembly 103 and arm 120. Extended portion 194 enables faucet system 100 to accommodate complex ceiling structures (e.g., vaulted ceiling structures) by facilitating movement of arm 120 at a distance from housing assembly 103. In various embodiments, the extended portion 194 may include an elongated coupling, a post, a rod, a beam, a pipe, or any other suitable structure configured to extend between the housing assembly 103 and the arm 120 to facilitate coupling therebetween.

Figure 11:
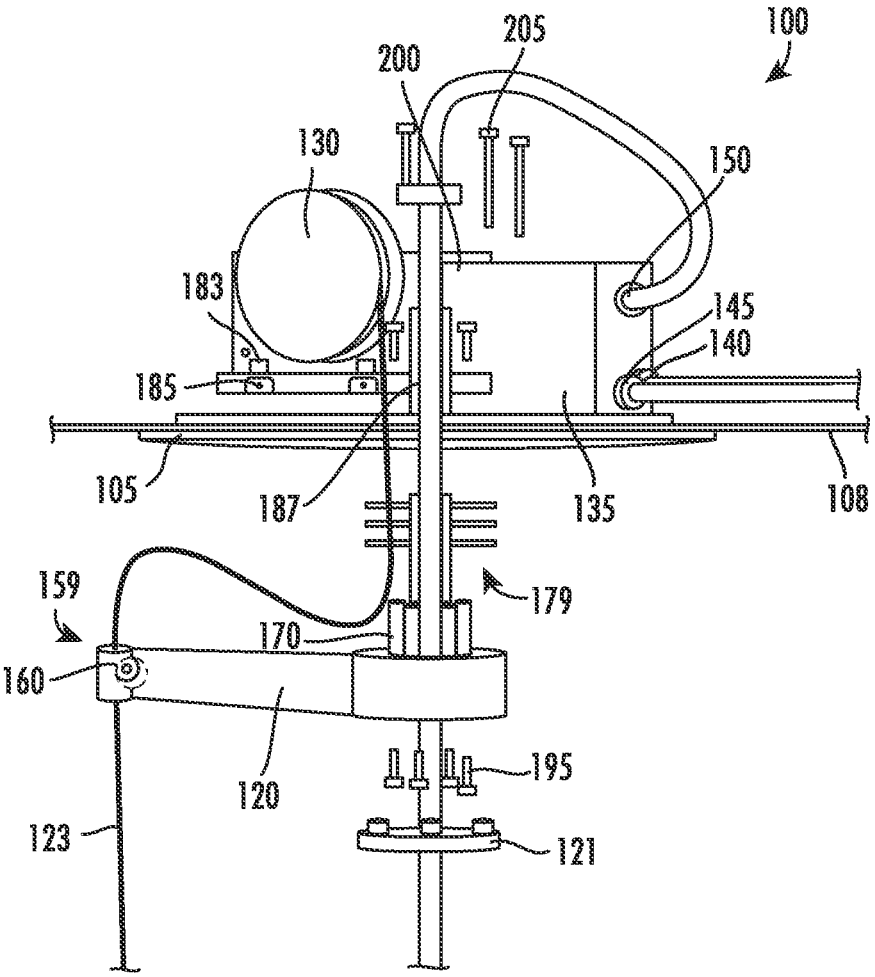
FIG. 11 is a schematic representation of a partially exploded side view of a faucet system without a control housing, according to an exemplary embodiment.
Figure 12:
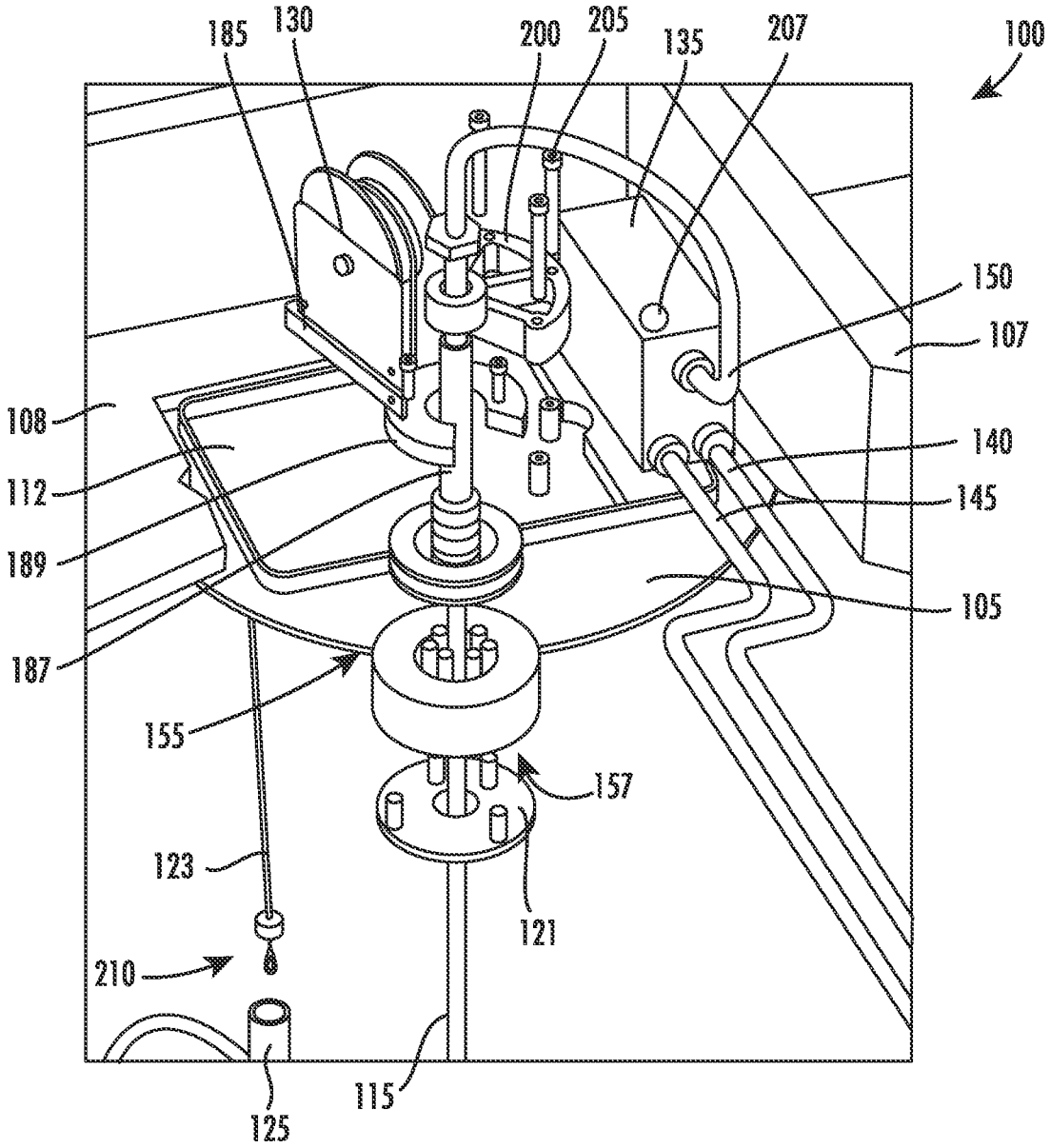
FIG. 12 is a schematic representation of a partially exploded perspective view of a faucet system without a control housing, according to an exemplary embodiment.

FIGS. 11 and 12 show partially exploded side and perspective views, respectively, of a faucet system near a ceiling surface 108, according to an exemplary embodiment. FIGS. 11 and 12 illustrate relative configurations of components within faucet system 100 contained within a housing assembly 103 and coupled components disposed beneath base plate 105 (e.g., within hose assembly 109). As shown, center post 187 provides structural support to components within a housing assembly 103. In various embodiments, center post 187 may include fixture 200, configured to engage with hose 115 and bottom portion 112. Fixture 200 may be fixed in place via fasteners 205, which engage with bottom portion 112. In addition, fasteners 195 (e.g., screws, bolts, etc.) may be implemented to couple cap 121 to rotatable arm 120. As shown in FIG. 12, cord 123, which extends below ceiling surface 108, has a terminal end 210 that is configured to engage with coupling 125.

In various embodiments, mixing valve 135, which is disposed within housing assembly 103, may include a receiver 207. In various embodiments, receiver 207 may be configured to receive signals via WiFi, near field communication (NFC), Bluetooth, etc.

Figure 13:
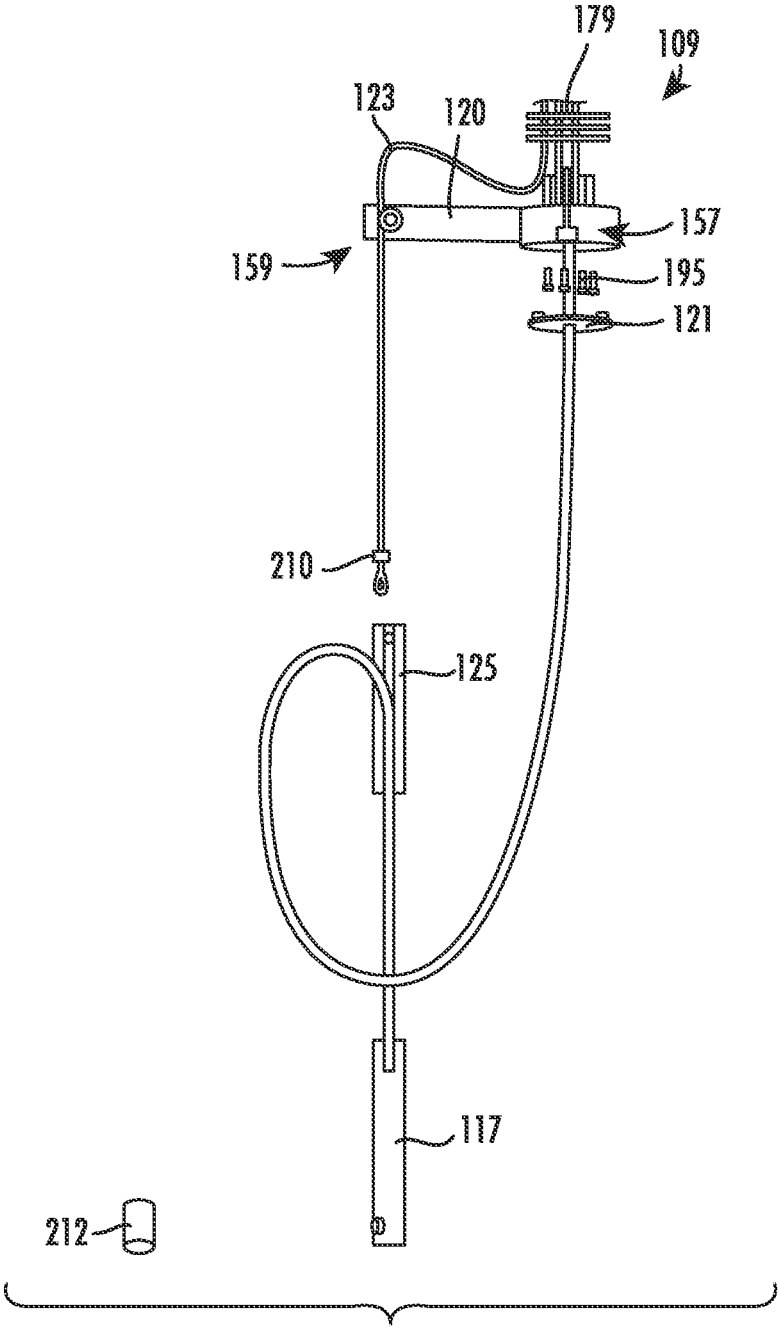
FIG. 13 is a schematic representation of a side view of a faucet system near a hose assembly, according to an exemplary embodiment.

FIG. 13 shows a side view of a faucet system 100 near hose assembly 109, according to an exemplary embodiments. As shown, hose 115 extends through a proximal end 157 of rotatable arm 120 into a space below a ceiling surface (e.g., ceiling surface 108) and a ceiling structure (e.g., ceiling structure 107). Cord 123 also extends through rotatable arm 120 at a distal end 159. In various embodiments, cord 123 may pass through an entire length of rotatable arm 120. In other embodiments, and as shown in FIG. 13, cord 123 may only pass through a portion of rotatable arm 120. A terminal end 210 of cord 123 extends below rotatable arm 120 and is configured to engage with coupling 125. As shown, coupling 125 is configured to engage with hose 115 to facilitate positioning thereof. In various embodiments, coupling 125 locks onto cord 123, which prevents movement of coupling 123 therethrough. Hose assembly 109 may be located proximate to a control knob 212, which is configured to control operation of a mixing valve (e.g., 135) within system 100.

Figure 14:
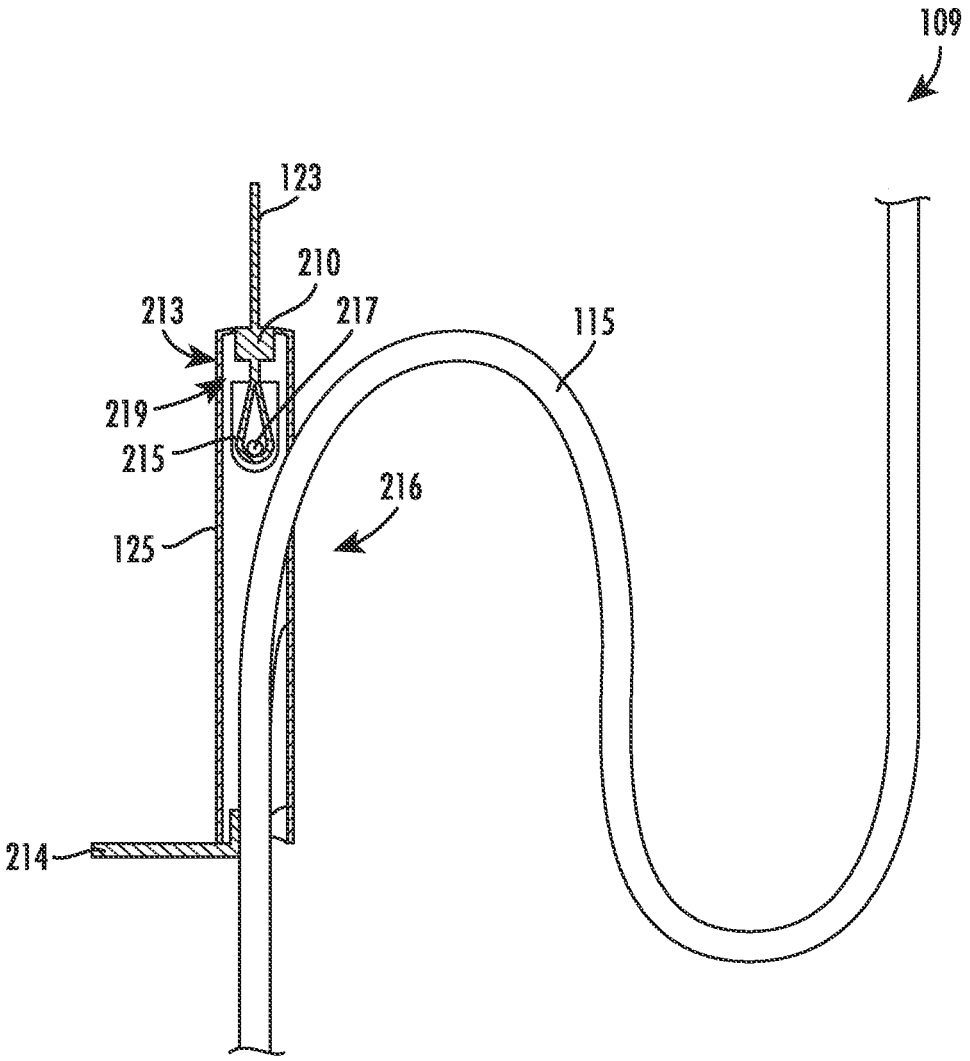
FIG. 14 is a side cross-sectional view of the faucet system of FIG. 9 near a coupling, according to an exemplary embodiment.

FIG. 14 shows a side cross-sectional view of a hose assembly 109 within faucet system 100 near coupling 125, according to an exemplary embodiment. As shown in FIG. 11, hose 115 is configured to engage with coupling 125 via an opening 216, through which flexible 115 may be fitted. A terminal end 210 of cord 123 is configured to fit within a first end 213 of coupling 125. A tab 217 within the first end 213 of coupling 125 is configured to receive a hook or loop 215, which is formed at the terminal end 210 of cord 123. The terminal end 210 of cord 123 is further configured to engage with fixture 219, disposed within the first end 213 of coupling 125. Connection of cord 123 to coupling 125 enables hose 115 to be particularly positioned. Cord 123, as previously described, is supported by wheel 130 (which may be and/or coupled to a counterbalance wheel or pulley) to maintain a constant length of extension of cord 123 through base plate 105. In various embodiments wherein wheel 130 is a counterbalance wheel or pulley, a counterbalance weight may be adjustable. In various embodiments, cord 123 may be extended or retracted by a spring and/or retraction mechanism within or coupled to wheel 130 (disposed within housing assembly 103). A handle 214, located at a second end of coupling 125 opposite first end 213, may facilitate movement of coupling 125 and connected hose 115.

During operation, hose assembly 109 may be repositioned (e.g., via spray head 117 and/or handle 214 on coupling 125), causing cord 123 to undergo tension and/or slack. Tension and/or slack on cord 123 is realized by wheel 130 and a coupled (and/or contained) counterweight, which causes cord 123 to extend or retract accordingly to enable spray head 117 and hose assembly 109 components to maintain the repositioned configuration. As previously described, coupling 125 facilitates managing slack within hose 115 as it may clamp or otherwise lock hose 115 in position. Managing the amount of slack in the hose enables the faucet system to vertically position the spray head 117 without requiring a mechanism for increasing or decreasing a length of the hose 115 (e.g., via a reel). In various embodiments, hose 115 may be configured (within hose assembly 109) to have a looped slack shape (as shown in FIG. 13) or an S-shaped slack (as shown in FIG. 14). In various other embodiments, hose 115 may be configured to have a slack shape beyond the looped shape or S-shape. In yet other embodiments, hose 115 may be adjustable within hose assembly 109, such that it can be re-configured to selectively have slack resembling a looped shape, S-shape, or any other desired configuration. Adjustment of cord 123 (e.g., via handle 214 on coupling 125) enables hose assembly 109 components to extend or retract within a range of potential lengths, thereby enabling faucet system 100 to operate within a range of ceiling structures.

Figure 15:
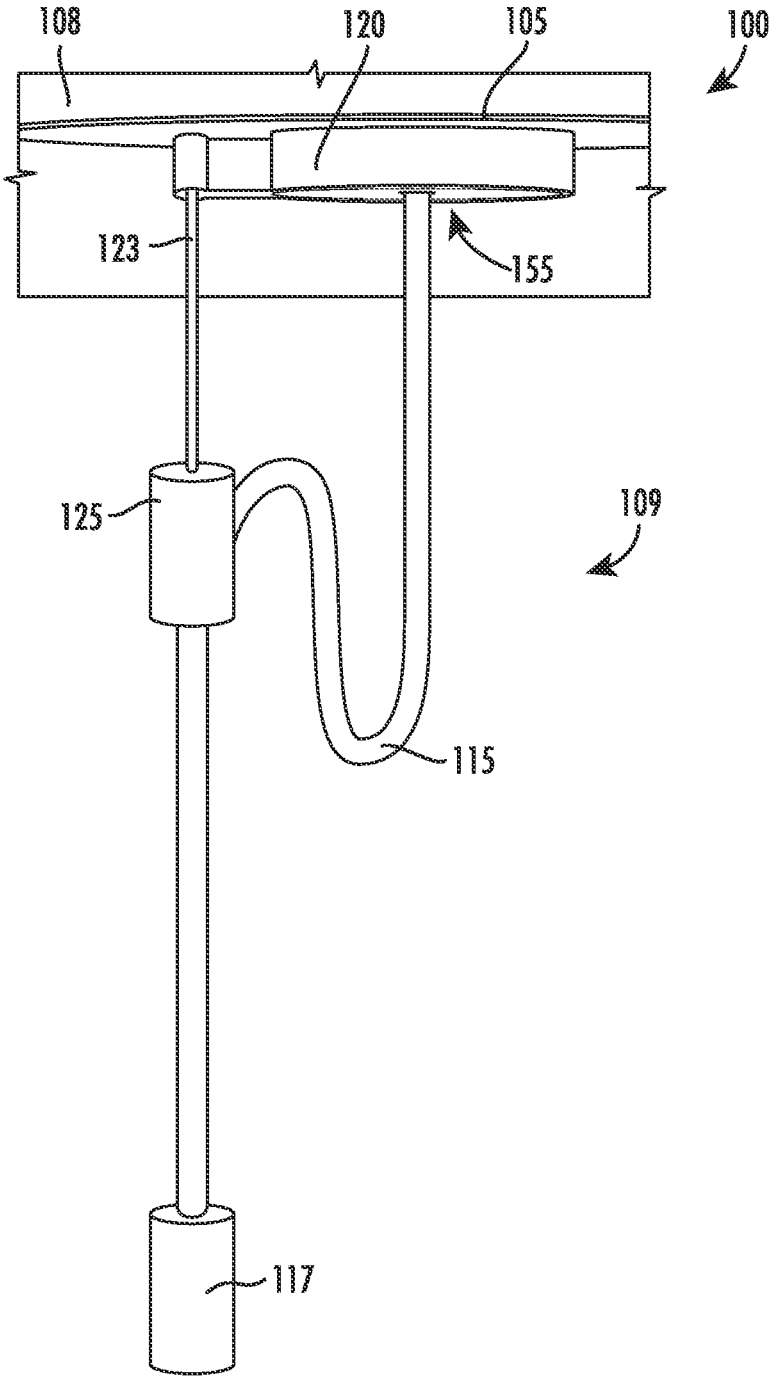
FIG. 15 is a side view of a faucet system, according to an exemplary embodiment.

FIG. 15 shows a side view of a faucet system 100 near hose assembly 109, according to an exemplary embodiment. FIG. 15 shows a faucet system 100 installed within a ceiling structure (e.g., ceiling structure 107), with a base plate 105 and hose assembly 109 disposed beneath a ceiling surface 108. FIG. 15 illustrates relative configurations of components within faucet system 100, and specifically within hose assembly 109, wherein hose 115 extends below ceiling surface 108 through base plate 105 and engages with coupling 125, which facilitates placement and positioning of hose 115 and spray head 117.

Figure 16:
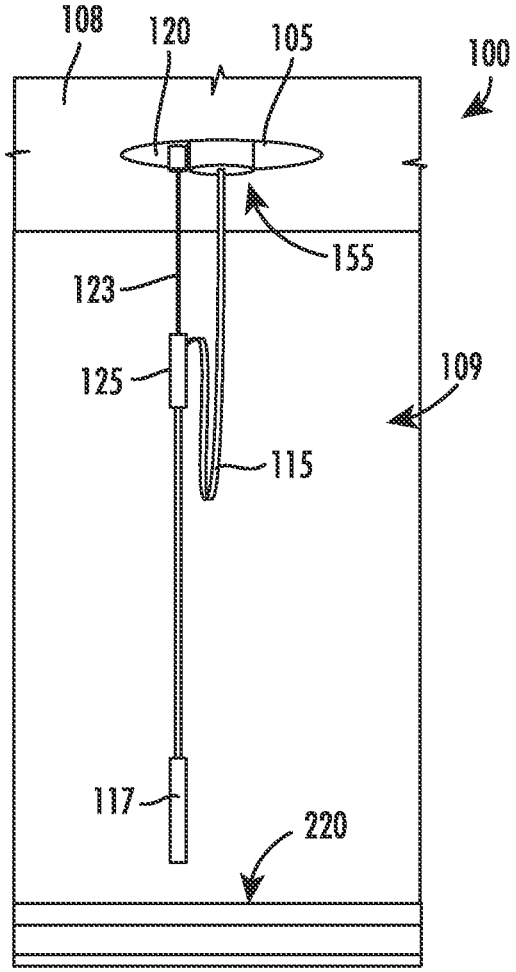
FIG. 16 is a side view of the faucet system of FIG. 15 in a first configuration near a sink, according to an exemplary embodiment.
Figure 17:
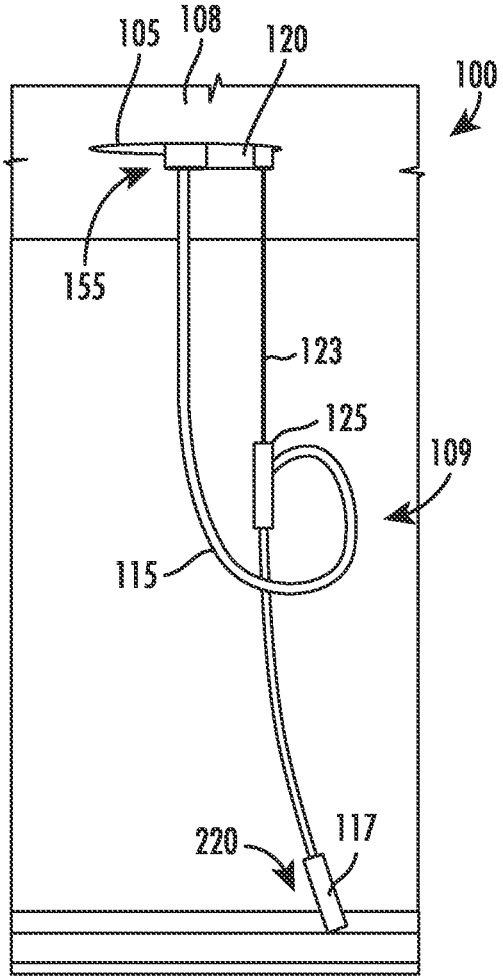
FIG. 17 is a side view of the faucet system of FIG. 15 in a second configuration near a sink, according to an exemplary embodiment.
Figure 18:
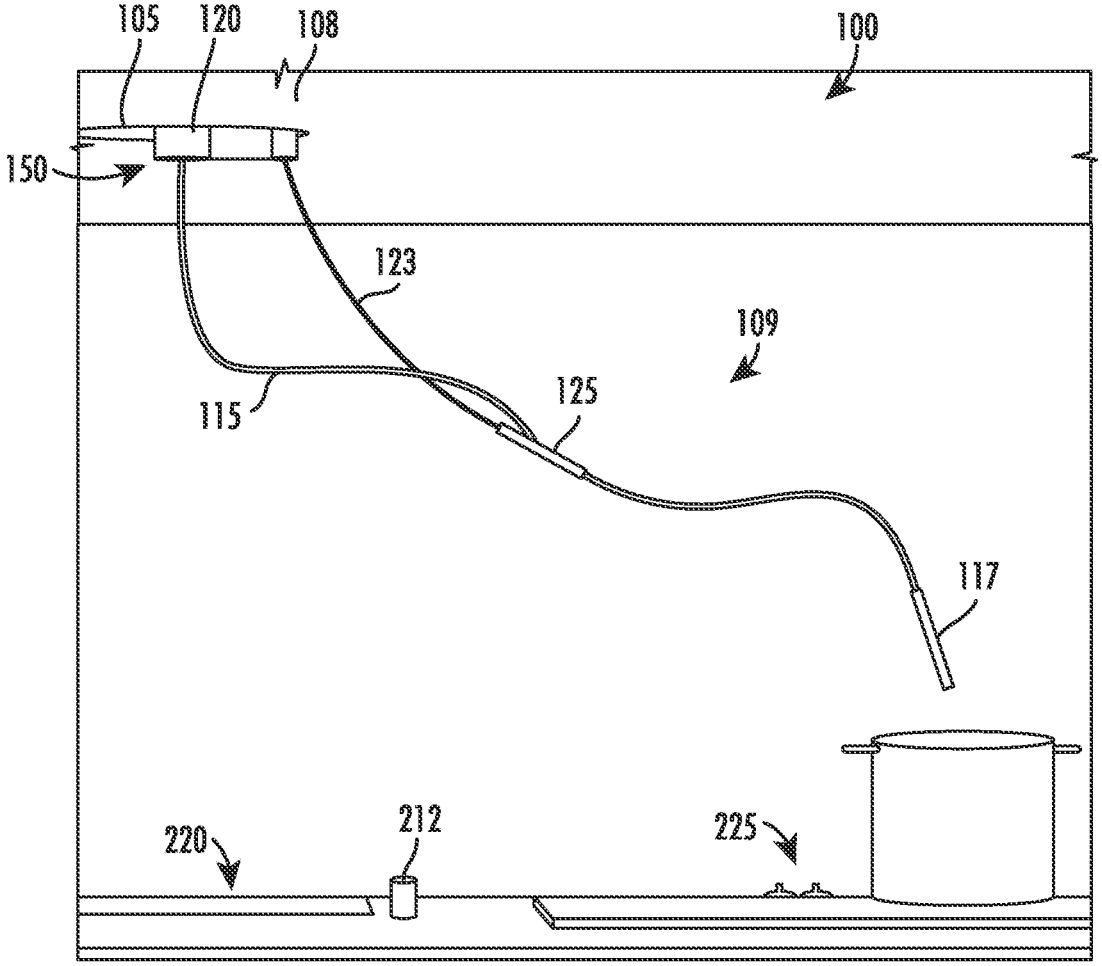
FIG. 18 is a side view of the faucet system of FIG. 15 in a third configuration near a sink, according to an exemplary embodiment.

FIGS. 16-18 show side views of a faucet system 100 near hose assembly 109, according to exemplary embodiments. FIG. 16 shows a configuration of system 100 wherein hose 115 and spray head 177 are positioned a distance above a work area 220 (e.g., kitchen sink), via an adjustment of coupling 125. FIG. 17 shows an alternate configuration of system 100 wherein rotatable arm 120 is rotated and hose 115 and spray head 117 may extend into a work area 220 (e.g., kitchen sink), via an adjustment of coupling 125 (e.g., via extension of cord 123). FIG. 18 shows yet another alternate configuration of faucet system 100 wherein hose 115 and spray head 117 may be extended to reach a second work area 225, which is located a distance from work area 220. In various other embodiments, faucet system 100 may be positioned in any conceivable configuration allowable by a rotation radius of rotatable arm 120, a length of hose 115, and a length of cord 123.

Figure 19:
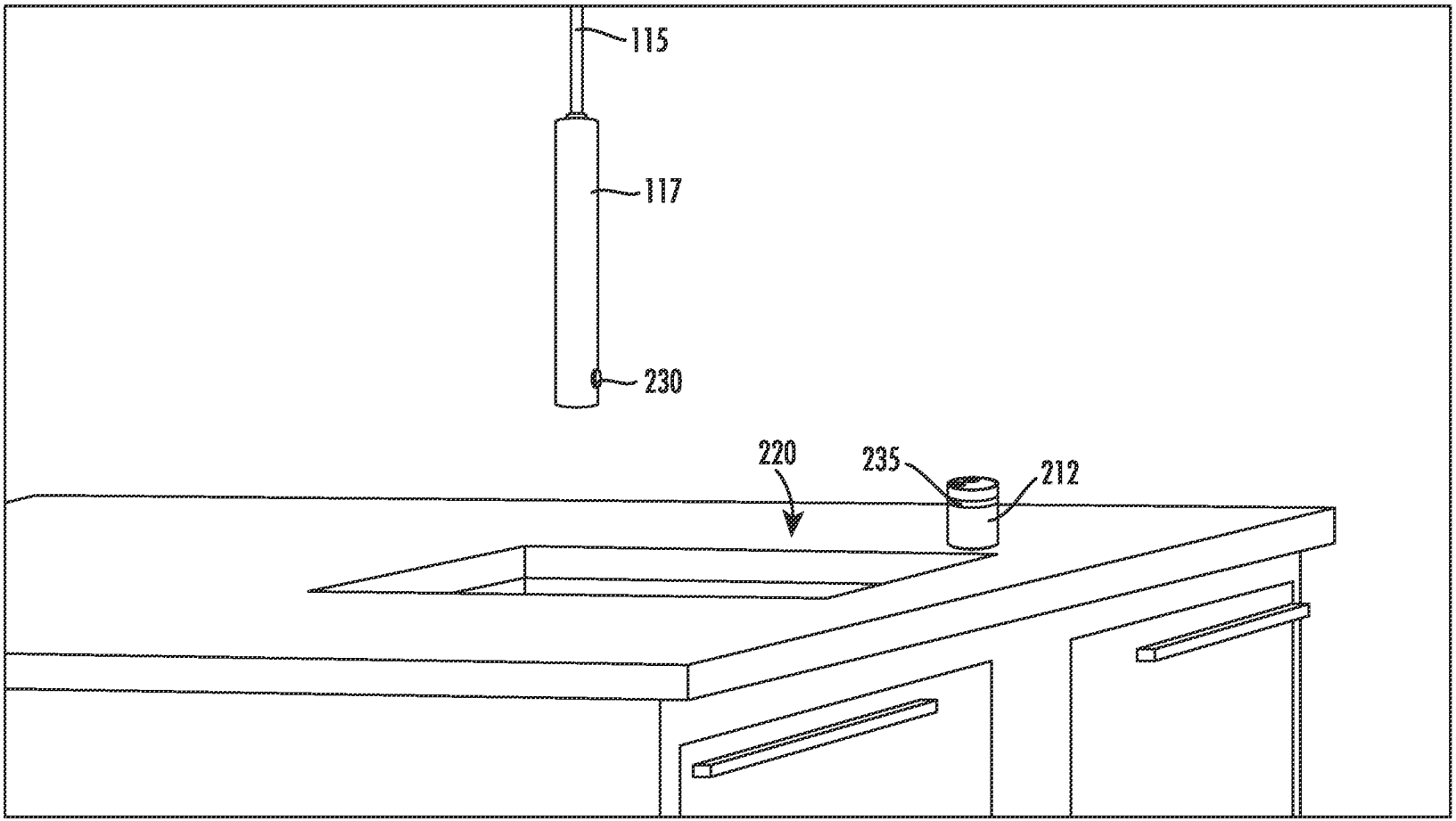
FIG. 19 is a perspective view of a faucet system near a spray head and control knob, according to an exemplary embodiment.

FIG. 19 shows a perspective view of a faucet system 100 near spray head 117. As shown in FIG. 19, spray head 117 is coupled to a terminal endofhose 115 and may be positioned (e.g., via movement of coupling 125) above a work space 220 (e.g., kitchen sink). Spray head 117 may include one or more buttons 230, which may facilitate control of water flowing out of faucet system 100. In various embodiments, button 230 may be a lever, knob, sliding mechanism, switch, or any other mechanical control known in the art. In various embodiments, button 230 may facilitate control of a flow of water, a temperature of water, a flow rate of water, or a combination thereof. As shown in FIG. 19, faucet system 100 may also include a control knob 212, disposed near a work area 220 and away from a ceiling surface (e.g., ceiling surface 108). Control knob 212 may be configured to control operation of a mixing valve (e.g., mixing valve 135). In various embodiments, control knob 212 may be configured to control operation of a mixing valve via wireless (e.g., WiFi, Bluetooth, NFC, etc.) or wired communication. In various embodiments, control knob 212 may have an indicator strip 235 that is configured to facilitate control of a mixing valve. In various embodiments, the indicator strip 235 may display different colors associated with a temperature of water (e.g., blue for cold water). In other embodiments, indicator strip 235 may control a water temperature, flow, flow rate, or combination thereof. In various exemplary embodiments, control knob 235 may be a switch, a remote, an interactive display unit, graphical user interface joystick, or any other suitable control mechanism known in the art.

Figure 20:
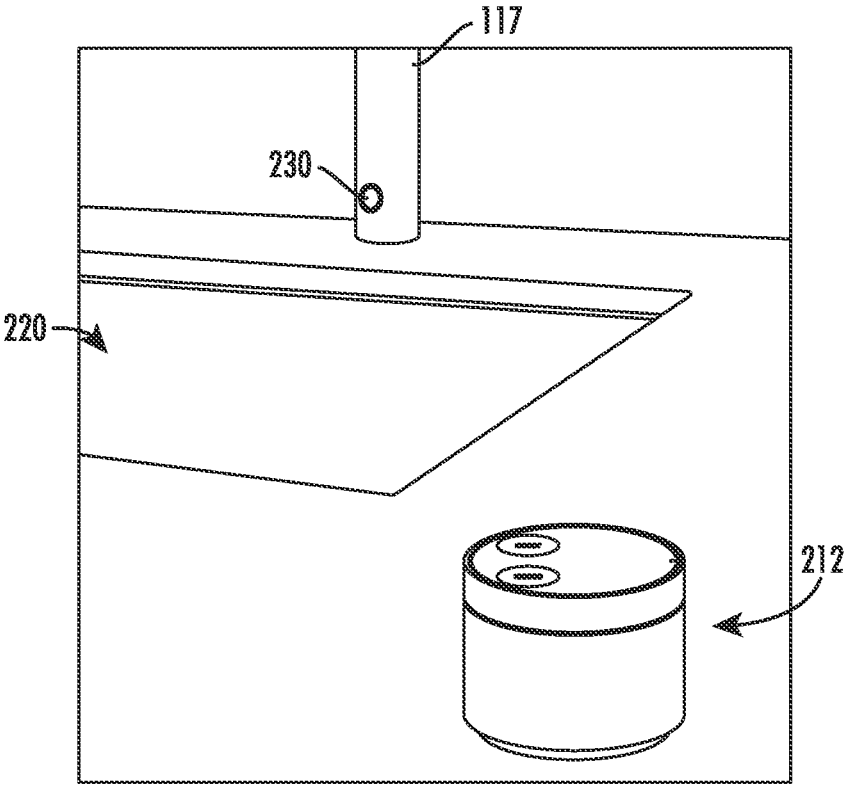
FIG. 20 is a perspective view of a faucet system near a spray head and a control knob, according to another exemplary embodiment.
Figure 21:
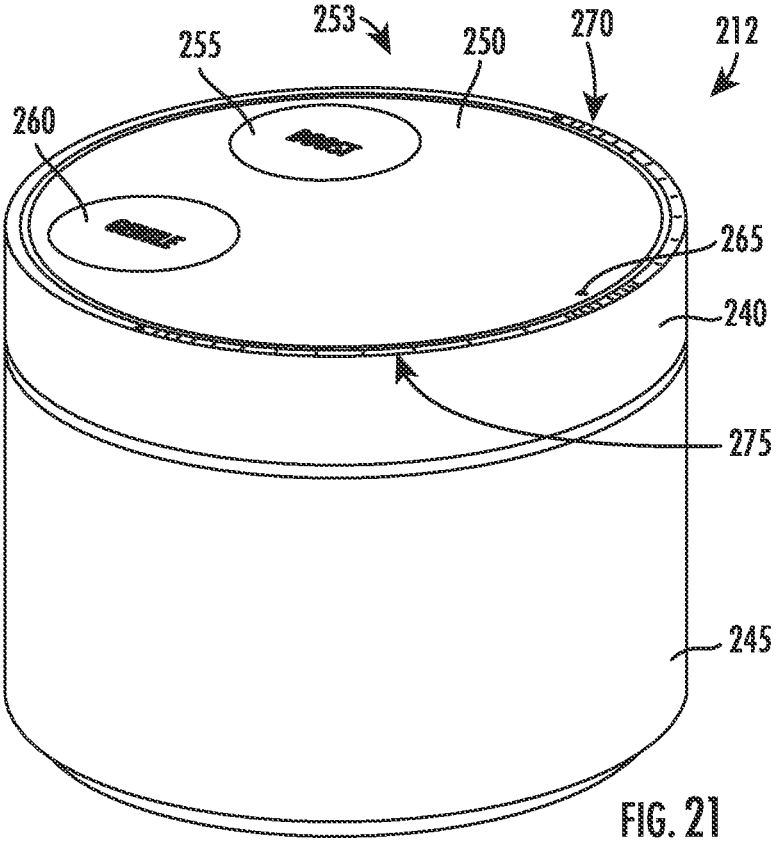
FIG. 21 is a perspective view of the control knob of FIG. 20, according to an exemplary embodiment.

FIG. 20 shows a perspective view of faucet system 100 near a control knob 212, according to an exemplary embodiment. As shown, control knob 212 may be mounted on or near a work area 220 and may be configured to enable control of components within faucet system 100 including, but not limited to, water mixing valve 135 and spray head 117. Control knob 212 may be configured to control faucet system 100 via one or more wired and/or wireless connections (e.g., Bluetooth, WiFi, NFC, etc.). In various embodiments control knob 212 may be fixedly mounted (e.g., via one or more fasteners, anchors, etc.) or movably mounted (e.g., via one or more magnets, hooks, on or near work area 220. FIG. 21 shows a perspective view of control knob 212, according to an exemplary embodiment. As shown, control knob 212 includes a top portion 240, a bottom portion 245, and a central portion 250. In various embodiments, top portion 240 may rotate about central portion 250 relative to bottom portion 245. In various embodiments, both top portion 240 and bottom portion 245 may rotate about central portion 250. In various embodiments, each of top portion 240, bottom portion 245, and central portion 250 consist of individual components which are mutually coupled via one or more fasteners, joints, bearings, and/or any other implement known in the art. In some embodiments, central portion 250 and bottom portion 245 form a single piece, which is configured to fit substantially within top portion 240.

As shown, control knob 212 may include buttons 255 and 260 located on or within a top surface 253 of central portion 250. Button 255 and/or button 260 may be configured to activate in response to an applied pressure (e.g., a user pressing button 255 and/or 260) or touch (e.g., a user touching button 255 and/or 260). In some embodiments, buttons 255 and/or 260 may depress, recede, or otherwise move relative to top surface 253. In some embodiments, buttons 255 and/or 260 may provide feedback in response to touch, such as, but not limited to a sound, haptic feedback, a change in color, etc.

Figure 22:
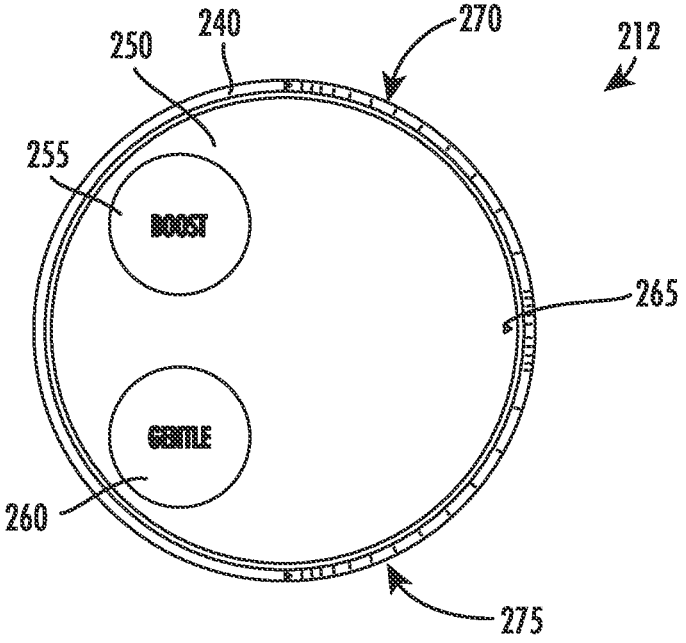
FIGS. 22-25 show top views of the control knob of FIG. 20, according to an exemplary embodiment.

FIG. 22 shows a top view of control knob 212, according to an exemplary embodiment. As shown, control knob 212 may include a temperature indicator 265 and temperature guides 270 and 275. In various embodiments, top portion 240 may rotate relative to bottom portion and/or central portion 250 to facilitate changing a temperature of water flowing through faucet system 100. As top portion 240 rotates, temperature guides 270 and 275 are repositioned relative to temperature indicator 265 to provide an indication of the water temperature. In various embodiments, the temperature guides 270 and 275 may include different colored dashes to indicate a spectrum of controllable temperature (e.g., red dashes may correspond to hot temperatures and blue dashes may correspond to cold temperatures). In various other embodiments, temperature guides 270 and/or 275 may include written indications of target water temperatures and/or amounts of water temperature increases. In various embodiments, temperature indicator 265 and temperature guides 270 and/or 275 may include notches, ridges, dots, arrows, or any other visual feature to indicate adjustable limits for water temperature control. In various embodiments, the control knob 212 includes one or more stops (e.g., mechanical stops, magnetic stops) such that movement of the top portion 240 is limited relative to the bottom portion 245. In some embodiments, the one or more stops may prevent the top and bottom portions 240, 245 from exceeding maximum hot and/or cold settings.

Figure 23:
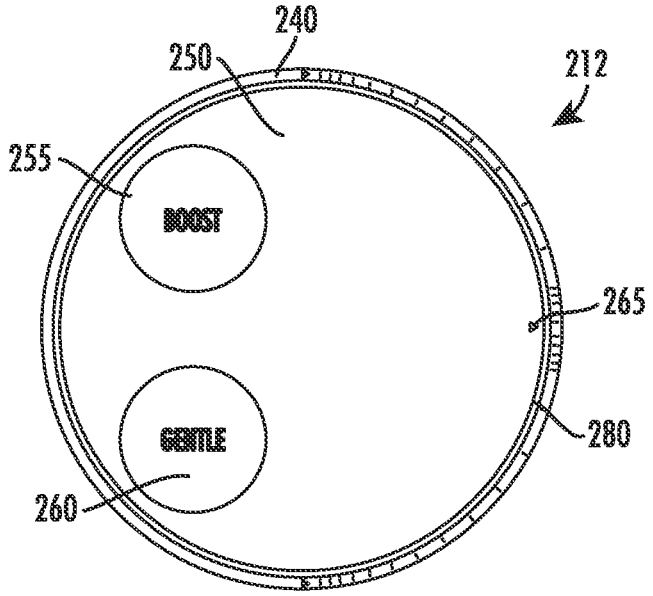
Figure 24:
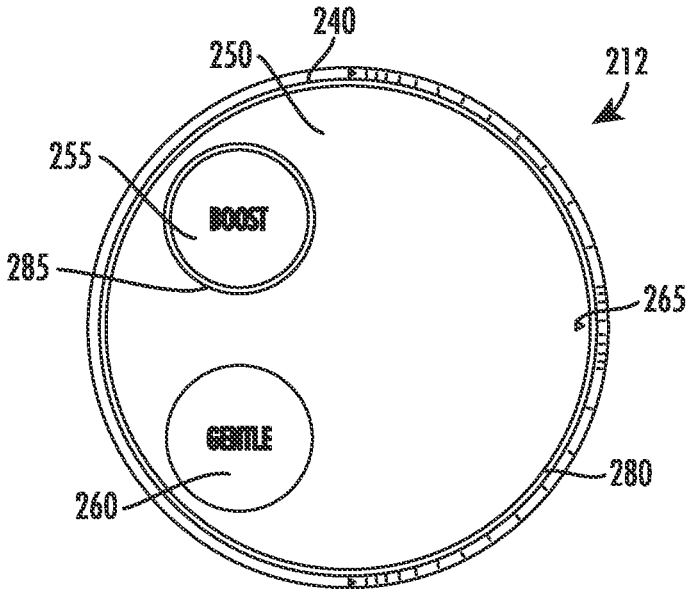
Figure 25:
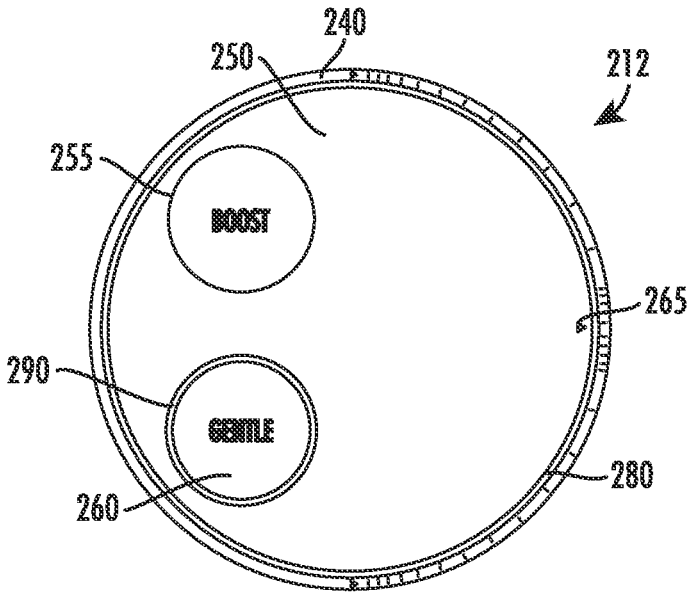

FIGS. 23-25 show top views of control knob 212 within faucet system 100, according to various exemplary embodiments. Control knob 212 may operate when placed into an "on" state. In various embodiments, control knob 212 may be placed into an "on" state when one or more components (e.g., top portion 240, bottom portion 245, central portion 250, buttons 255 and/or 260) included within control knob 212 are touched, pressed, and/or rotated. In various embodiments, a light indicator 280 may illuminate to indicate when the control knob 212 is in an "on" state. In various embodiments, control knob 212 may control water flow through faucet system 100 via one or more preset modes. Although FIG. 23 shows light indicator 280 to be configured as a circumferential light, light indicator 280 may include one or more discrete lights or illuminated regions disposed anywhere on top portion 240 (e.g., on top surface 253).

In some embodiments, control knob 212 may operate in a default mode when placed into an "on" state. In various embodiments, the default mode may be predetermined by a user or a manufacturer of faucet system 100. In some embodiments, the default mode may cause control knob 212 to operate faucet system 100 such that water flow (i.e., through the mixing valve 135 and/or spray head 117) is at or near a default threshold level. In various embodiments, the default mode may facilitate splash minimization (e.g., by controlling or limiting a rate of flow of water through the mixing valve 135 and/or spray head 117) and/or water use reduction (e.g., by controlling or limiting an amount of flow of water through the mixing valve 135 and/or spray head 117). In various embodiments, the default mode may control the faucet system 100 such that water flows from the spray head 117 at a rate of approximately 1.5 gallons per minute. In some embodiments, control knob 212 may operate in a high flow mode. In some embodiments, the high flow mode may be initiated when button 255 ("boost") is activated. As shown in FIG. 24, a first button indicator light 285 may be visible around button 255 to indicate selection of the high flow mode. In various embodiments, the high flow mode may cause control knob 212 to operate faucet system 100 such that water flow (i.e., rate of flow and/or amount of flow) is at or near a high threshold level. In various embodiments, the high flow mode may facilitate reduction of time for filling containers (e.g., pots, pans, etc.), improved cleaning of various objects (e.g., dishes, sink), efficient cooling of hot items (e.g., cooked ingredients), and/or improved lubrication of a garbage disposal in or near the work area 220. In various embodiments, the high flow mode may control the faucet system 100 such that water flows from the spray head 117 at a rate of approximately 1.8 gallons per minute. In some embodiments, control knob 212 may operate in a low flow mode. In some embodiments, the low flow mode may be initiated when button 260 ("gentle") is activated. As shown in FIG. 25, a second button indicator light 290 may be visible around button 260 to indicate selection of the low flow mode. In various embodiments, the low flow mode may cause control knob 212 to operate faucet system 100 such that water flow is at or near a low threshold level. In various embodiments, the low flow mode may facilitate decreased water use, gentle water spray from spray head 117, and/or controlled filling of containers (e.g., bottles, cups, measuring implements, etc.) within or near work area 220. In various embodiments, the low flow mode may control the faucet system 100 such that water flows from the spray head 117 at a rate of approximately 1.1 gallons per minute.

Figure 26:
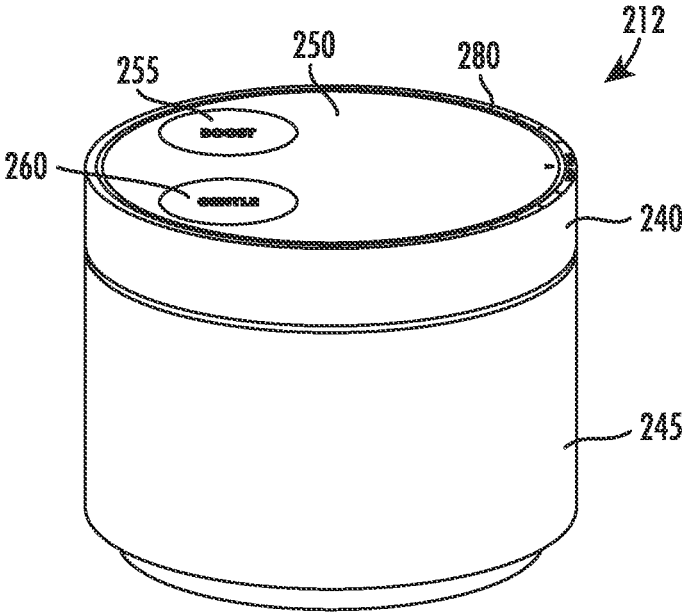
FIGS. 26-27 show perspective views of the control knob of FIG. 20, according to an exemplary embodiment.
Figure 27:
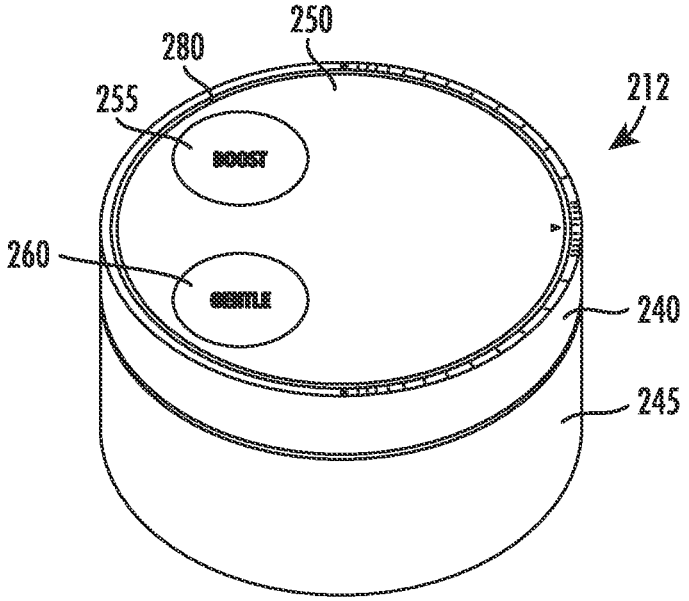
Figure 28:
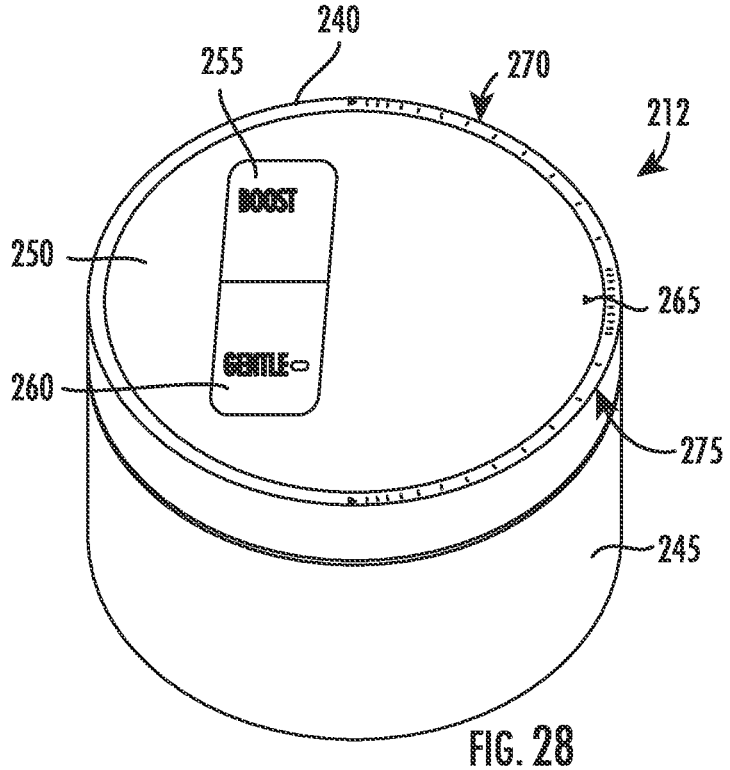
FIG. 28 shows a perspective view of a control knob, according to an exemplary embodiment.

FIGS. 26-27 show perspective views of control knob 212, according to various exemplary embodiments. In various embodiments, circumferential light indicator 280 may be configured to provide an indication of a status of control knob 212 and/or components within faucet system 100. In some embodiments, circumferential light indicator 280 may display different colors and/or selectively turn on or off based on the status of control knob 212 and/or components within faucet system 100. In various embodiments, circumferential light indicator 280 may display a blue color as shown in FIG. 26 when control knob 212 and/or faucet system 100 are operating normally. In various embodiments, circumferential light indicator 280 may display a red color as shown in FIG. 27 when control knob 212 and/or a component within faucet system 100 are operating abnormally. In some embodiments, abnormal operation of control knob 212 and/or faucet system 100 may include, but is not limited to, a low battery within control knob 212, a faulty connection (wireless and/or wired) between control knob 212 and one or more communicatively coupled components within faucet system 100, and/or a malfunctioning valve within faucet system 100. In various embodiments, the control knob 212 may be configured such that buttons 255, 260 are disposed adjacent to each other, as shown in FIG. 28. In some embodiments, the buttons 255, 260 are configured to be circular, ellipsoidal, square, rectangular, or a combination thereof. In various embodiments, at least one of the buttons 255, 260 may include one or more indicator lights disposed therein, which are configured to indicate activation of the button and/or a status of the control knob 212.

Figure 29:
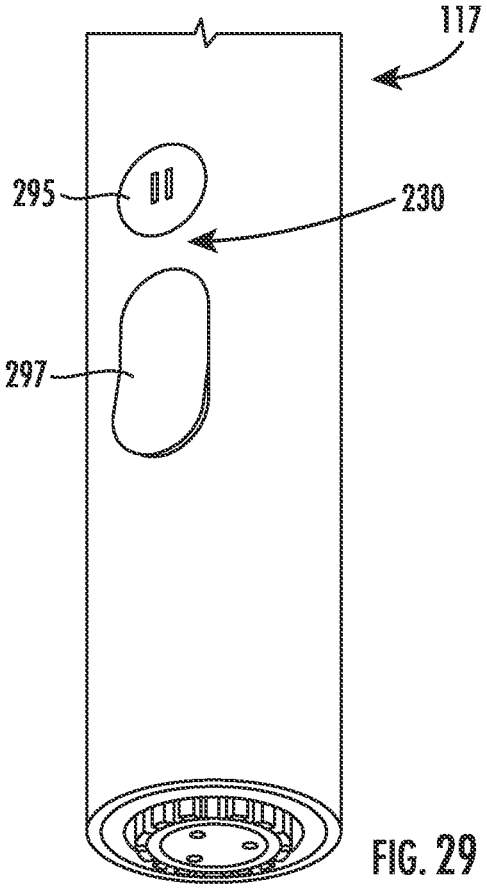
FIG. 29 shows a perspective view of a spray head near a control region, according to an exemplary embodiment.
Figure 30:
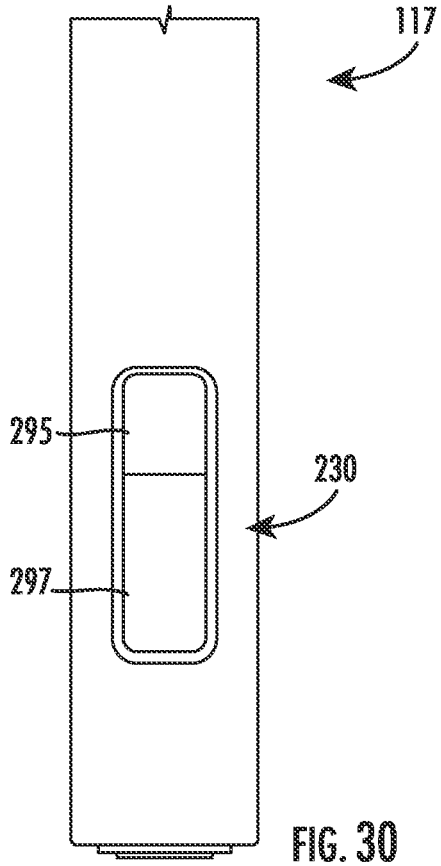
FIG. 30 shows a perspective view of a spray head near a control region, according to another exemplary embodiment.

Similar to the control knob 212, the spray head 117 may also have variation in the type and configuration of the one or more buttons 230 disposed therein. As shown in FIG. 29, the one or more buttons 230 disposed within the spray head may include one or more circular buttons 295 and/or switch type buttons 297. In various embodiments, at least one of the buttons 295, 297 may be configured to cause the start or cessation of water flowing out of the spray head, and/or may control an amount or rate of flow of water exiting the spray head 117. In some embodiments, at least one of the buttons 295, 297 may control a spray type, spray configuration, 23 or spray mode of the spray head. In various embodiments, the buttons 295, 297 may be configured as adjacent buttons, as shown in FIG. 30.

Notwithstanding the embodiments described above in FIGS. 1-30, various modifications and inclusions to those embodiments are contemplated and considered within the scope of the present disclosure.

It is also to be understood that the construction and arrangement of the elements of the systems and methods as shown in the representative embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed.

Accordingly, all such modifications are intended to be included within the scope of the present disclosure. Any means-plus-function clause is intended to cover the structures described herein as performing the recited function and not only structural equivalents but also equivalent structures. Other substitutions, modifications, changes, and omissions may be made in the design, operating conditions, and arrangement of the preferred and other illustrative embodiments without departing from scope of the present disclosure or from the scope of the appended claims.

Furthermore, functions and procedures described above may be performed by specialized equipment designed to perform the particular functions and procedures. The functions may also be performed by general-use equipment that executes commands related to the functions and procedures, or each function and procedure may be performed by a different piece of equipment with one piece of equipment serving as control or with a separate control device.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

Moreover, although the figures show a specific order of method operations, the order of the operations may differ from what is depicted. Also, two or more operations may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection operations, processing operations, comparison operations, and decision operations.

What is claimed is:

1. A faucet system comprising:

a housing configured to be coupled to a ceiling structure and a baseplate;

a flexible hose fluidly coupled to the housing and configured to hang below the housing and to carry water;

a spray head disposed at a terminal end of the hose;

an extendable and retractable cord coupled to the housing; and a coupling connected to a terminal end of the cord, the coupling configured to hold the hose to control an amount of slack in the hose so as to allow a vertical position of the spray head to be adjusted such that a length of the cord below the housing is increased or decreased, without increasing or decreasing a length of the hose with respect to the housing.

2. The faucet system of claim 1, wherein the housing is disposed within the ceiling structure.

3. The faucet system of claim 1, wherein the housing is disposed below the ceiling structure.

4. The faucet system of claim 1, wherein the faucet system further comprises a controller, the controller configured to control a mixing valve within the housing.

5. The faucet system of claim 4, wherein the controller is configured to operate according to a plurality of modes, wherein each of the plurality of modes determines at least one of a temperature or a flow of water through the spray head.

6. The faucet system of claim 5, wherein the plurality of modes comprises a default mode, a gentle mode, and a boost mode.

7. A faucet system comprising:

a housing assembly;

a hose assembly coupled to the housing assembly, the hose assembly comprising:

a flexible hose configured to hang below the housing assembly;

a spray head disposed at a terminal end of the hose;

a cord extending from the housing assembly; and a coupling connected to a terminal end of the cord, the coupling configured to hold the hose to facilitate vertical positioning and movement of the hose and the spray head, such that a length of the cord below the housing is increased or decreased, without increasing or decreasing a length of the hose with respect to the housing.

8. The faucet system of claim 7, further comprising a rotatable arm coupled to the housing assembly, wherein the rotatable arm is configured to facilitate rotation and adjustment of the hose and a spray head, wherein the cord is configured to pass through the rotatable arm such that the terminal end of the cord extends from a distal end of the rotatable arm.

9. The faucet system of claim 7, wherein the cord is supported by a wheel disposed within the housing assembly.

10. The faucet system of claim 9, wherein the wheel is configured to maintain and adjust a length of the cord.

11. The faucet system of claim 10, wherein maintaining and adjusting the length of the cord include extending and retracting the cord.

12. The faucet system of claim 7, wherein the terminal end of the cord forms a loop, the loop being configured to connect to a tab disposed within the coupling.

13. A faucet system comprising:

a housing assembly configured to be coupled to a ceiling structure;

a hose assembly coupled to the housing assembly, the hose assembly comprising:

a flexible hose configured to hang below the housing assembly;

a spray head disposed at a terminal end of the hose;

a cord extending from the housing assembly; and a coupling connected to a terminal end of the cord, the coupling configured to hold the hose to facilitate vertical positioning and movement of the hose and the spray head, such that a length of the cord below the housing is increased or decreased, without increasing or decreasing a length of the hose with respect to the housing; and a control knob communicably coupled to the mixing valve, the control knob configured to control at least one of a temperature or a flow of water within the faucet system.

14. The faucet system of claim 13, wherein the control knob comprises a top portion and a bottom portion, wherein the top portion is configured to rotate relative to the bottom portion, and wherein rotation of the top portion controls at least one of the temperature or the flow of the water within the faucet system.

15. The faucet system of claim 14, wherein the top portion of the control knob includes one or more buttons disposed within a top surface, the one or more buttons configured to operate the faucet system based on one or more modes.

16. The faucet system of claim 15, wherein the one or more modes includes at least one of a default mode, a gentle mode, and a boost mode.

17. The faucet system of claim 13, wherein the housing assembly further comprises a rotatable arm coupled to the housing assembly, wherein the rotatable arm is configured to facilitate rotation and adjustment of the hose, wherein the cord is supported by the rotatable.

18. The faucet system of claim 17, wherein the housing assembly further comprises a wheel configured to maintain and adjust a length of the cord, and wherein the wheel is at least one of a counterbalance wheel.

* * * * *